US006703791B2

(12) United States Patent
Azuma

(10) Patent No.: US 6,703,791 B2
(45) Date of Patent: Mar. 9, 2004

(54) IMAGE DISPLAY DEVICE

(75) Inventor: Hisanobu Azuma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,145

(22) Filed: Nov. 7, 2001

(65) Prior Publication Data

US 2002/0063535 A1 May 30, 2002

(30) Foreign Application Priority Data

Nov. 9, 2000 (JP) ..... 2000-341263

(51) Int. Cl.[7] ..... G09G 3/10; G09G 3/20

(52) U.S. Cl. ..... 315/169.3; 315/169.1; 345/79; 345/76; 313/310

(58) Field of Search ..... 315/169.3, 169.1, 315/169.4; 313/500, 502, 504, 505, 517, 520, 310; 345/76, 84, 74.1, 78, 79; G09G 3/10, 3/20

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,455,597 A | * | 10/1995 | Nakamura et al. | 345/74.1 |
| 5,682,085 A | | 10/1997 | Suzuki et al. | 315/169.1 |
| 5,912,531 A | | 6/1999 | Hasegawa et al. | 313/495 |
| 6,144,350 A | * | 11/2000 | Fujii et al. | 345/74.1 |
| 6,288,494 B1 | * | 9/2001 | Tsukamoto et al. | 315/169.1 |
| 6,313,815 B1 | * | 11/2001 | Takeda et al. | 345/75.2 |

FOREIGN PATENT DOCUMENTS

| | | | |
|---|---|---|---|
| JP | 2-257551 | 10/1990 | H01J/31/15 |
| JP | 3-263742 | 11/1991 | H01J/31/12 |
| JP | 4-28137 | 1/1992 | H01J/1/30 |
| JP | 7-235256 | 9/1995 | H01J/1/30 |

OTHER PUBLICATIONS

R. Meyer et al. *Recent Development on "Microtips" Display at Leti*, Technical Digest of IVMC (1991) Nagahama, pp. 6–9.

* cited by examiner

*Primary Examiner*—Don Wong
*Assistant Examiner*—Trinh Vo Dinh
(74) *Attorney, Agent, or Firm*—Fitzpatrick, Cella, Harper & Scinto

(57) ABSTRACT

An image display device comprising an electron source and a display member for displaying an image by irradiation with electrons emitted from the electron source is provided, which is characterized in that the electron source has a plurality of units provided with a higher voltage electrode disposed on a substrate, lower voltage electrodes provided in parallel on both sides of the higher voltage electrode across the higher voltage device electrode and electron-emitting areas located between each of the lower voltage electrodes and the higher voltage electrode, electron beams emitted from each of the electron-emitting areas in each unit cross with each other, and an equipotential surface to be formed between the substrate and the display member has an area protruding to the display member side on the higher voltage electrode.

18 Claims, 17 Drawing Sheets

IMAGE DISPLAY DEVICE

BACKGROUND OF THE INVENTION

1. Field of the Invention

The present invention relates to an image display device for displaying an image on a display member by irradiation with electrons emitted from an electron source.

2. Related Background Art

Conventionally, two types of electron-emitting devices electron sources, hot cathode devices and cold cathode devices, are known. Examples of the cold cathode device include a surface conduction electron-emitting device, a field emission (hereinafter referred to as FE) electron-emitting device, a metal/insulating-layer/metal (hereinafter referred to as MIM) electron-emitting device. Application of these devices to, for example, an image display device, an image-forming apparatus such as an image-recording apparatus and a charged beam source has been studied.

In particular, as an application example of a surface conduction electron-emitting device to an image display device, an image display device that combines to use surface conduction electron-emitting devices and phosphors for emitting light by irradiation of electron beams has been studied as disclosed in U.S. Pat. No. 5,066,883 and Japanese Patent Application Laid-open Nos. 2-257551 and 4-28137 filed by the applicant of the present application. The image display device that combines to use surface conduction electron-emitting devices and phosphors is expected to have a property that is more excellent than that of conventional image display devices of other systems. For example, it is more excellent than a liquid crystal display device, which has been widely used in recent years, in that it does not need a back light because it is a self-luminescence type and that it has a wider view angle.

In addition, a method in which a number of FE electron-emitting devices are arranged to be driven is disclosed, for example, in U.S. Pat. No. 4,904,895 by the applicant of the present application. In addition, as an example in which an FE electron-emitting device is applied to an image display device, for example, a flat panel display reported by R. Meyer et al. is known (R. Meyer: "Recent Development on Microtips Display at LETI", Tech. Digest of 4th Int. Vacuum Microelectronics Conf., Nagahama, pp. 6–9 (1991)).

Among the image display devices using electron-emitting devices as described above, a thin plane type display device is attracting attention as a display device replacing a cathode-ray tube display device because it occupies less space and is light in weight.

FIG. 17 is a perspective view showing an example of a display panel portion forming a plane type image display device, which is shown with a part of the panel cut away in order to show an internal structure.

In the figure, reference numeral 3115 denotes a rear plate, 3116 denotes a side wall and 3117 denotes a face plate. The rear plate 3115, the side wall 3116 and the face plate 3117 form an envelope (an airtight container) for maintaining a vacuum inside the display panel.

A substrate 3111 is fixed to the rear plate 3115, and N×M cold cathode devices 3112 are formed on this substrate 3111 (N and M are positive integers equal to or larger than two and are properly set according to the target number of display pixels). In addition, as shown in FIG. 17 the N×M cold cathode devices 3112 are wired by M lines of row-directional wiring 3113 and N lines of the column-directional wiring 3114. A portion composed of the substrate 3111, the cold cathode device 3112, the row-directional wiring 3113 and the column-directional wiring 3114 is called a multi-electron beam source. In addition, an insulating layer (not shown) is formed between both the wiring at least in parts where the row-directional wiring 3113 and the column-directional wiring 3114 cross each other, whereby electrical insulation is maintained.

A fluorescent film 3118 consisting of a phosphor is formed on the lower surface of the face plate 3117, and the phosphors of three primary colors of red (R), green (G) and blue (B) (not shown) are arranged. An example of the phosphors is shown in FIG. 14. Here, a portion surrounded by dotted lines is referred to as a sub-pixel and a portion surrounded by solid lines is referred to as a pixel. One pixel is composed of three sub-pixels consisting of R, G and B. In addition, a black body (not shown) is provided among the above-mentioned phosphors forming the fluorescent film 3118. Moreover, a metal back 3119 made of Al or the like is formed on the surface on the rear plate 3115 side of the fluorescent film 3118.

Dx1 to Dxm, Dy1 to Dyn and Hv are terminals for electric connection of an airtight structure provided for electrically connecting the display panel and electric circuit (not-shown). Dx1 to Dxm, Dy1 to Dyn and Hv are electrically connected to the row-directional wiring 3113 of the multi-electron beam source, the column-directional wiring 3114 of the multi-electron beam source and the metal back 3119, respectively.

In addition, a vacuum in the order of $133\times10^{-6}$ Pa ($10^{-6}$ Torr) is maintained inside the above-mentioned airtight container.

FIG. 18 shows a schematic view of an electron beam spot shape and an amount of electron beams when electron beams emitted from a surface conduction electron-emitting device have collided against a phosphor (not shown) on the face plate 3117.

In the image display device using the above-described display panel, when a voltage is applied to each cold cathode device 3112 through the terminals Dx1 to Dxm and Dy1 to Dyn which are arranged outside the container, an electron is emitted from each cold cathode device 3112. At the same time, a high voltage of several hundreds of V to several kV is applied to the metal back 3119 through the terminal Hv which is arranged outside the container, whereby the emitted electrons are accelerated and caused to collide against the internal surface of the face plate 3117. Consequently, the phosphors of each color forming the fluorescent film 3118 are excited to emit light and an image is displayed.

It has been found that the above-described display panel of the image display device has the following problems.

In a thin image display device, there is an upper limit to the high voltage that can be applied to a part between a rear plate and a face plate. Thus, it is absolutely necessary to increase the amount of current from electron-emitting devices in order to realize a desired light-emitting luminance, which causes Coulomb degradation of the phosphor. In particular, in the case of an electron emitting device in which emitted electrons have an initial velocity in a direction other than the direction of the electrode from the electron-emitting device toward the face plate as in the surface conduction electron-emitting device as shown in FIG. 18, there is a deviation in the current density distribution, which makes the degradation of a phosphor more serious (a horizontal FE of FIG. 19 (FE provided with both an emitter and a gate on the surface of a substrate) is also a device having the same problem). That is, since an amount of electron applied to one sub-pixel in order to realize desired luminance concentrates in one part within the one sub-pixel, the degradation of the phosphor in that part is aggravated rapidly and, as a result, the life of the phosphor is rendered short.

Thus, we have found that it is effective to disperse and arrange electron-emitting areas of electron-emitting devices (one unit) forming one sub-pixel in a plurality of places in order to eliminate the deviation of the current density distribution and, as a result, prevent progress of partial degradation of the phosphor. If two electron-emitting areas are provided, it becomes possible to reduce the amount of current from one of the electron-emitting areas by fifty percent and the concentration of the current density is improved by approximately fifty percent as long as the luminance thereof are equivalent. Thus, it becomes possible to increase the life of the phosphor so as to be twice as long as that in the conventional display panel of the image display device. We have found anew that it is possible to prevent degradation of the phosphor with such a structure.

Note that, such a structure involves a problem in the size of an electron beam spot and its accessible position as compared with the structure in which electron-emitting areas are not dispersed and arranged in a plurality of places. As measures for coping with problems due to the size of an electron beam spot and its accessible position, an attempt has been made to solve such problems by separately providing an electrode for shaping a beam as described in Japanese Patent Application Laid-open No. 3-263742 or by controlling the overlapping degree of beams in terms of the distances between a plurality of electron-emitting areas as described in Japanese Patent Application Laid-open No. 7-235256. However, in the cases of the technologies disclosed in these patent applications, there still are problems. In Japanese Patent Application Laid-open No. 3-263742, the structure of a display device is made rather complicated and manufacturing of the display device is difficult because an electrode for shaping a beam is provided. In addition, in Japanese Patent Application Laid-open No. 7-235256, a sufficient space is required for providing electron-emitting devices on a rear plate in order to realize desired intervals between electron-emitting areas and the display device can not obtain sufficiently high definition. Thus, these problems should be solved for a practical use.

In addition, in these Japanese patent applications, as too much importance is placed on the improvement in terms of the size of a beam spot; thus, if electron beams are focused excessively and a plurality of electron beams overlap each other excessively, deviation of a current density may be more obvious. In such a case, the problem of degradation of the phosphor may be more serious.

SUMMARY OF THE INVENTION

The present invention has been made in view of the above, and an object of the present invention is therefore to provide an image display device which makes it possible to prevent degradation of a phosphor and to realize high definition with a simple structure.

According to the present invention, there is provided an image display device comprising an electron source and a display member for displaying an image by irradiation with electrons emitted from the electron source, characterized in that the electron source has a plurality of units provided with a higher voltage electrode disposed on a substrate, lower voltage electrodes provided in parallel on both sides of the higher voltage electrode across the voltage electrode and electron-emitting areas located between the lower voltage electrodes and the higher voltage electrode, electron beams emitted from each of the electron-emitting areas in each unit cross with each other, and an equipotential surface to be formed between the substrate and the display member has an area protruding to the display member side on the higher voltage electrode.

Further, according to the present invention, there is provided an image display device comprising an electron source and a display member for displaying an image by irradiation with electrons emitted from the electron source, characterized in that the electron source has a plurality of units provided with a higher voltage device electrode disposed on a substrate, lower voltage device electrodes provided in parallel on both sides of the higher voltage device electrode across the higher voltage device electrode, electron-emitting areas located between the lower voltage device electrodes and the higher voltage device electrode and a wiring electrode connected to and disposed on the higher voltage device electrode, electron beams emitted from each of the electron-emitting areas in each unit cross with each other, and an equipotential surface to be formed between the substrate and the display member has an area protruding to the display member side on the wiring electrode.

DETAILED DESCRIPTION OF THE PREFERRED EMBODIMENTS

Figure 1:
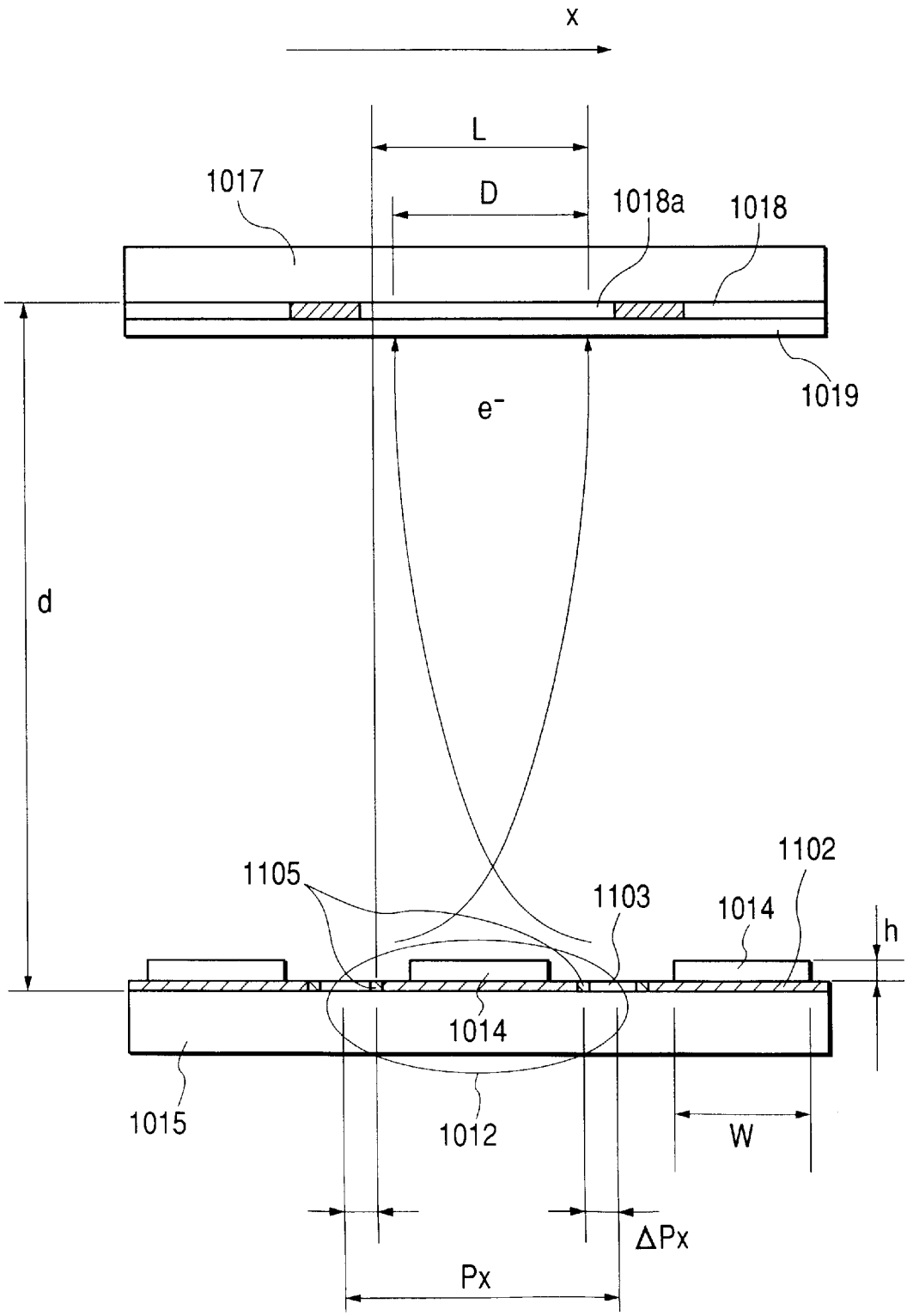
FIG. 1 is a schematic sectional view in the x direction of a display panel in accordance with an embodiment of the present invention.

According to the present invention, in an image display device comprising an electron source and a display member for displaying an image by irradiation with electrons emitted from the electron source, the electron source has a plurality of units provided with a higher voltage electrode disposed on a substrate, lower voltage electrodes provided in parallel on both sides of the higher voltage electrode across the voltage electrode and electron-emitting areas located between the lower voltage electrodes and the higher voltage electrode, electron beams emitted from each of the electron-emitting areas in each unit cross with each other, and an equipotential surface to be formed between the substrate and the display member has an area protruding to the display member side on the higher voltage electrode.

According to the present invention, in an image display device comprising an electron source and a display member for displaying an image by irradiation with electrons emitted from the electron source, the electron source has a plurality of units provided with a higher voltage electrode disposed on a substrate, lower voltage electrodes provided in parallel on both sides of the higher voltage electrode across the higher voltage electrode and electron-emitting areas located between the lower voltage electrodes and the higher voltage electrode, electron beams emitted from the electron-emitting areas in each unit cross with each other, and the higher voltage electrode has a part higher than the lower voltage electrode.

According to the present invention, in an image display device comprising an electron source and a display member for displaying an image by irradiation with electrons emitted from the electron source, the electron source has a plurality of units provided with a higher voltage electrode disposed on a substrate, lower voltage electrodes provided in parallel on both sides of the higher voltage electrode across the higher voltage electrode and an electron-emitting area located between the lower voltage electrodes and the higher voltage electrode, electron beams emitted from each of the electron-emitting areas in each unit cross with each other, and the higher voltage electrode has a surface whose height gradually increases or rapidly increases from the electron-emitting area side.

According to the present invention, in an image display device comprising an electron source and a display member for displaying an image by irradiation with electrons emitted from the electron source, the electron source has a plurality of units provided with a higher voltage electrode disposed on a substrate, lower voltage electrodes provided in parallel on both sides of the higher voltage electrode across the higher voltage electrode and electron-emitting areas located between the lower voltage electrodes and the higher voltage electrode, electron beams emitted from each of the electron-emitting areas in each unit cross with each other, and the higher voltage electrode has a surface whose height gradually increases or rapidly increases from the electron-emitting area side and has a part higher than the lower voltage electrode.

In an image display device, in the case where the higher voltage electrode has the part higher than the lower voltage electrode, it is preferable that the height h ($\mu$m) of the higher voltage electrode from the surfaces of the lower voltage electrodes meets the following expression when the interval between the substrate and an anode electrode provided on the display member is d ($\mu$m), the potential difference between the higher voltage electrode and the lower voltage electrodes is Vf (V), the potential difference between the anode electrode and the lower voltage electrodes is Va (V), the pitch width in the direction of one unit of higher voltage electrode and lower voltage electrodes is Px ($\mu$m) and the distance from the electron-emitting areas and the one unit end is $\Delta$Px ($\mu$m).

$$(va/d)\times\beta h>Vf \quad (1).$$

$$h<(A+(B\times In(2Lo/(Px-2\Delta Px)))^{0.5})/\beta \quad (2).$$

Here, A is represented by the following expression with the width W ($\mu$m) of the part of the higher voltage electrode higher than the surfaces of the lower voltage electrodes as a parameter.

$$A=-0.5\alpha W+26.2$$

Lo ($\mu$m) is a curvilinear progression quantity of electron beams and is represented by the following expression.

$$Lo=2Kd(Vf/Va)^{0.5}$$

K and B are constants and $\alpha$ and $\beta$ are correction factors depending on a shape of the higher voltage electrode.

It is preferable that both $\alpha$ and $\beta$ are in the range of 0.8 to 1.0.

Further, it is preferable that the plurality of units are wired in a matrix shape.

Further, it is preferable that the display member has a plurality of pixels consisting of a plurality of sub-pixels of different colors, and each of the plurality of units is arranged for each of the sub-pixels.

According to the present invention, in an image display device comprising an electron source and a display member for displaying an image by irradiation with electrons emitted from the electron source, the electron source has a plurality of units provided with a higher voltage device electrode disposed on a substrate, lower voltage device electrodes provided in parallel on both sides of the higher voltage device electrode across the voltage electrode, electron-emitting areas located between the lower voltage device electrodes and the higher voltage device electrode and a wiring electrode connected to and disposed on the higher voltage device electrode, electron beams emitted from each of the electron-emitting areas in each unit cross with each other, and an equipotential surface to be formed between the substrate and the display member has an area protruding to the display member side on the wiring electrode.

According to the present invention, in an image display device comprising an electron source and a display member for displaying an image by irradiation with electrons emitted from the electron source, the electron source has a plurality of units provided with a higher voltage device electrode disposed on a substrate, lower voltage device electrodes provided in parallel on both sides of the higher voltage device electrode across the voltage electrode, electron-emitting areas located between the lower voltage device electrodes and the higher voltage device electrode and a wiring electrode connected to and disposed on the higher voltage device electrode, electron beams emitted from each of the electron-emitting areas in each unit cross with each other, and the wiring electrode has a part higher than the lower voltage electrode.

According to the present invention, in an image display device comprising an electron source and a display member for displaying an image by irradiation with electrons emitted from the electron source, electron source has a plurality of units provided with a higher voltage device electrode disposed on a substrate, lower voltage device electrodes provided in parallel on both sides of the higher voltage device electrode across the voltage electrode, electron-emitting areas located between the lower voltage device electrodes and the higher voltage device electrode and a wiring electrode connected to and disposed on the higher voltage device electrode, electron beams emitted from each of the electron-emitting areas in each unit cross with each other, and a step is formed by the higher voltage device electrode and the wiring electrode.

According to the present invention, in an image display device comprising an electron source and a display member for displaying an image by irradiation with electrons emitted from the electron source, electron source has a plurality of units provided with a higher voltage device electrode disposed on a substrate, lower voltage device electrodes provided in parallel on both sides of the higher voltage device electrode across the voltage electrode, electron-emitting areas located between the lower voltage device electrodes and the higher voltage device electrode and a wiring electrode connected to and disposed on the higher voltage device electrode, electron beams emitted from each of the electron-emitting areas in each unit cross with each other, and a step is formed by the higher voltage device electrode and the wiring electrode and the wiring electrode has a part higher than the lower voltage electrode.

In an image display device, in the case where the wiring electrode has the part higher than the lower voltage device electrode, it is preferable that the height h ($\mu$m) of the wiring electrode from the surfaces of the lower voltage device electrodes meets the following expression when the interval between the substrate and an anode electrode provided on the display member is d ($\mu$m), the potential difference between the higher voltage device electrode and the lower voltage device electrodes is Vf (V), the potential difference between the anode electrode and the lower voltage device electrodes is Va (V), the pitch width in the direction of one unit of higher voltage device electrode and lower voltage device electrodes is Px ($\mu$m) and the distance from the electron-emitting areas and the one unit end is $\Delta$Px ($\mu$m).

$$(va/d)\times\beta h>Vf \quad (1).$$

$$h<(A+(B\times In(2Lo/(Px-2\Delta Px)))^{0.5})/\beta \quad (2).$$

Here, A is represented by the following expression with the width W ($\mu$m) of the part of the wiring electrode higher than the surfaces of the lower voltage electrodes as a parameter.

$$A=-0.5\alpha W+26.2$$

Lo ($\mu$m) is a curvilinear progression quantity of electron beams and is represented by the following expression.

$$Lo=2Kd(Vf/Va)^{0.5}$$

K and B are constants and $\alpha$ and $\beta$ are correction factors depending on a shape of the wiring electrode.

It is preferable that $\alpha$ and $\beta$ are in the range of 0.8 to 1.0.

Further, it is preferable that the lower voltage device electrodes are connected in the row-directional wiring, the wiring electrode forms the column-directional wiring, and the plurality of units are wired in a matrix shape by a plurality of lines of the row-directional wiring and a plurality of lines of the column-directional wiring.

Moreover, it is preferable that the display member has a plurality of pixels consisting of a plurality of sub-pixels of different colors, and each of the plurality of units is arranged for each of the sub-pixels.

Furthermore, it is preferable that the electron-emitting areas are arranged among the higher voltage device electrode and the lower voltage device electrodes and are electroconductive films connected to both the device electrodes.

A preferred embodiment of the present invention will be hereinafter described with reference to the drawings. However, the present invention is not restricted to this embodiment mode.

The present invention is characterized in that, in order to prevent degradation in the phosphor and realize a display device with a high definition by causing electron beams to focus with a simple configuration, that one unit of an electron-emitting device for irradiating electrons on one sub-pixel has a plurality of electron-emitting areas, one unit of the device provides all of a higher voltage electrode, electron-emitting areas and lower voltage electrodes on the surface of a rear plate and disposes the higher voltage electrode in the center of one unit of electron-emitting devices, and that an equipotential surface to be formed between the rear plate and a face plate has an area protruding to the front face plate side on the higher voltage electrode. More specifically, the present invention is characterized in that the shape of the higher voltage electrode in the height direction (direction from the rear plate toward the face plate) is devised.

Technical characteristics of the configuration of the present invention will be hereinafter described more specifically.

First, a plurality of electron-emitting areas are dispersed to be arranged, whereby concentration of a current density is mitigated and degradation of the phosphor is prevented. We took notice of the fact that, in this case, it is preferable in terms of focusing electron beams that a higher voltage electrode, electron-emitting areas and lower voltage electrodes be provided together on a unit of a device (this device configuration is hereinafter referred to as a plane type device) and the higher voltage electrode is arranged in the center of one unit of an electron-emitting device. That is, a device configuration is formed as a plane type device rather than a step type device as described in Japanese Patent Application Laid-open No. 7-235256 and one unit of an electron-emitting device is arranged such that a higher voltage electrode is disposed in the center, whereby electron beams take trajectories such that they are temporarily collected in the center of the device (because electron beams take trajectories to cross each other as shown in FIG. 1 to be described later). Thus, at the point in time when electrons are emitted, the expansion of the electron beams can be suppressed compared with a device that emits electron beams from electron-emitting areas toward the outside (the side separating from the center of one unit of an electron-emitting device).

Then, in this case, the higher voltage electrode is formed such that an equipotential surface to be formed between a substrate and a display member has an area protruding to the display member side on the higher voltage electrode or on a wiring electrode on the high voltage side. More specifically, a shape in the height direction of the higher voltage electrode positioned in the center is formed such that (1) the equipotential surface has a portion higher than lower voltage electrodes and, preferably, the wiring electrode on the high voltage side has a higher portion than the lower voltage electrodes, and/or (2) the equipotential surface has a surface on which its height gradually increases or rapidly increases from the electron-emitting area side and, preferably, a step is formed by a device electrode and a wiring electrode on the high voltage side. As a result, since emitted electrons can be pushed back to the electron-emitting areas with an extremely simple structure without separately providing an electrode for shaping electron beams as described in Japanese Patent Application Laid-open No. 3-263742 and without making an interval among the electron-emitting areas large, electron beams are focused. Here, the above-mentioned structures of (1) and (2) pushing emitted electrons back to the electron-emitting area will be described more in detail with reference to FIGS. 2, 3, 4 and 5.

Figure 2:
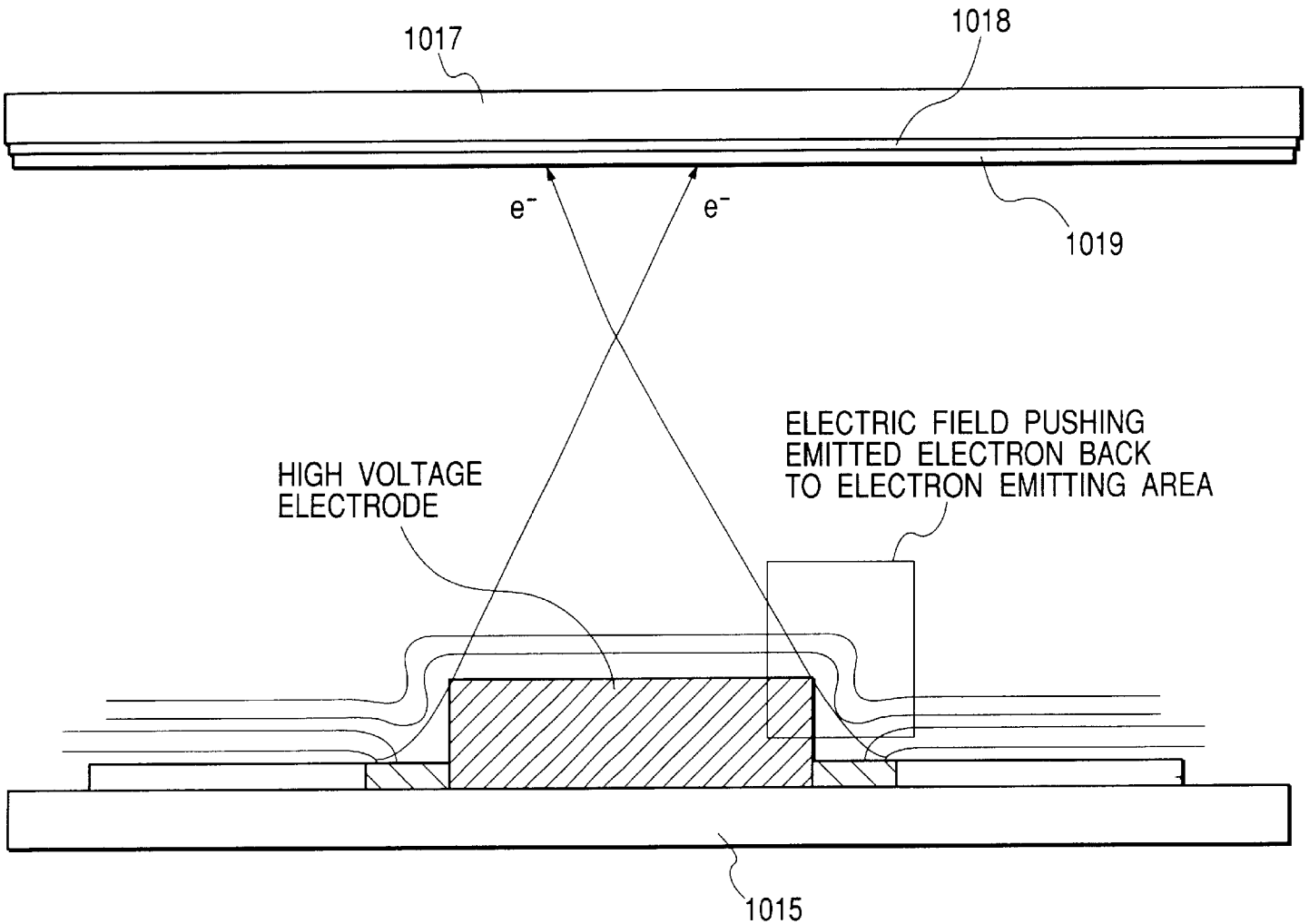
FIG. 2 illustrates a structure in which an equipotential surface to be formed between a substrate and a display member has an area protruding to the display member side on a higher voltage electrode.
Figure 3:
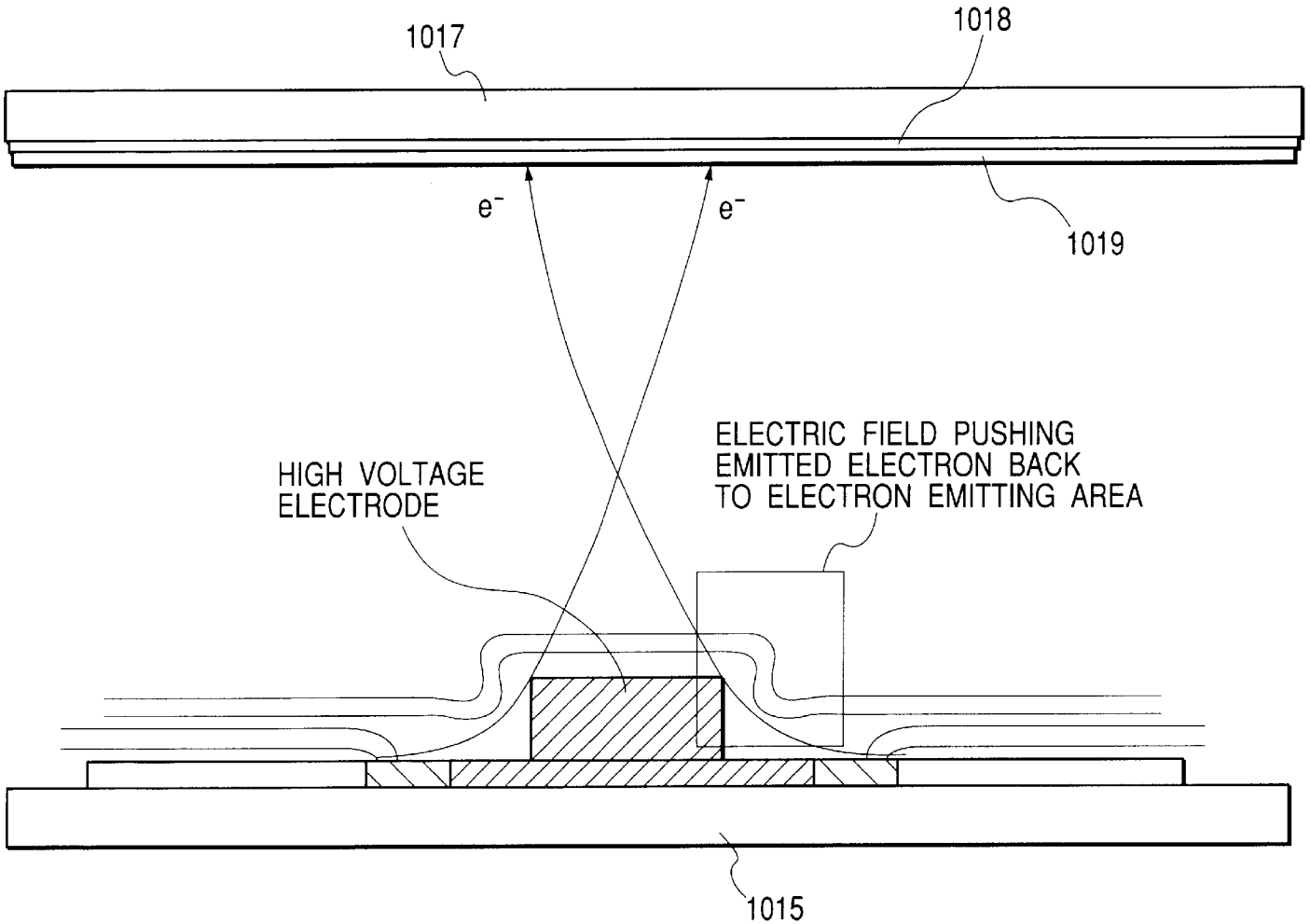
FIG. 3 illustrates a structure in which an equipotential surface to be formed between a substrate and a display member has an area protruding to the display member side on a higher voltage electrode.
Figure 4:
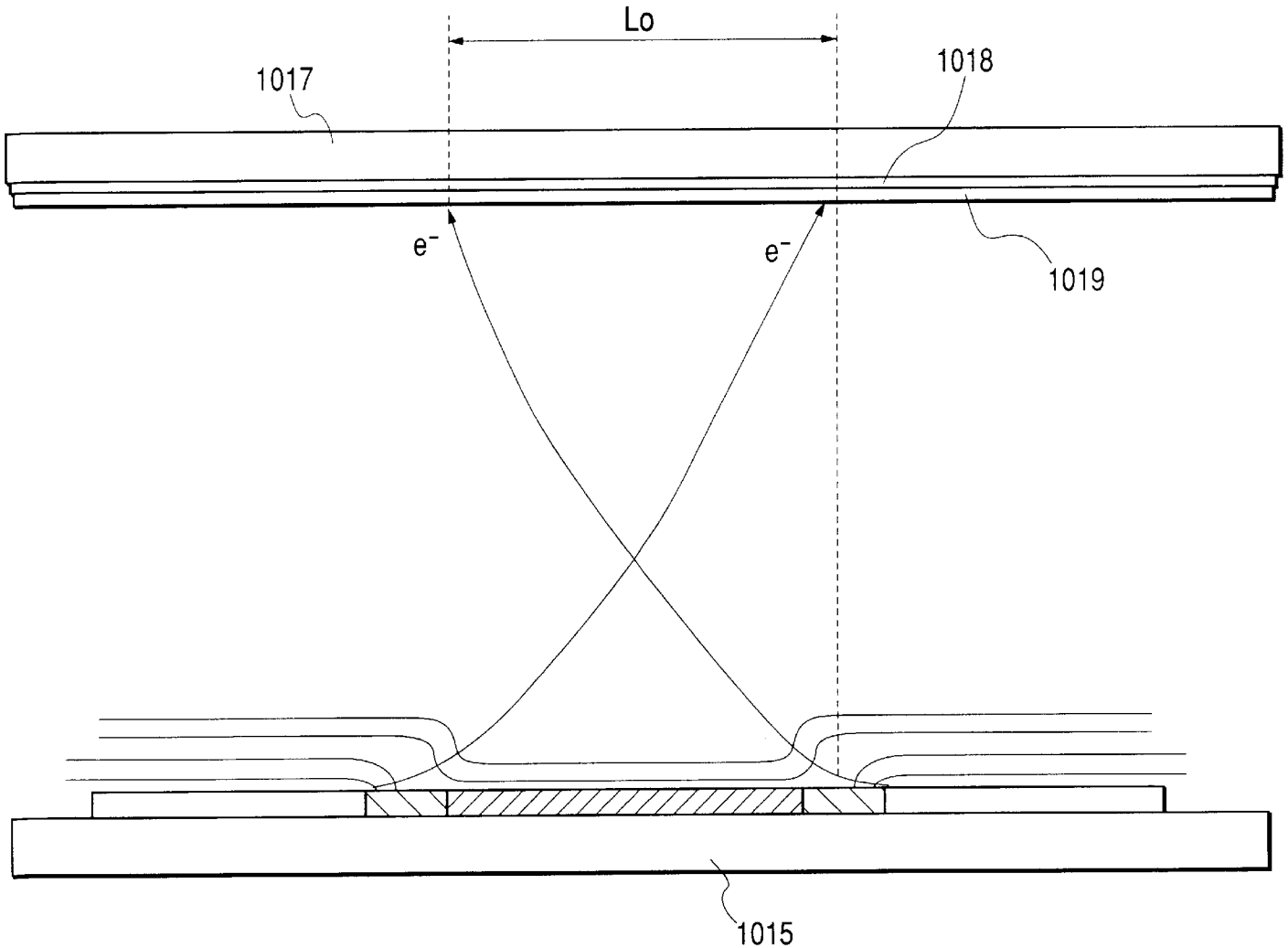
FIG. 4 illustrates a structure in which an equipotential surface to be formed between a substrate and a display member does not have an area protruding to the display member side on a higher voltage electrode.
Figure 5:
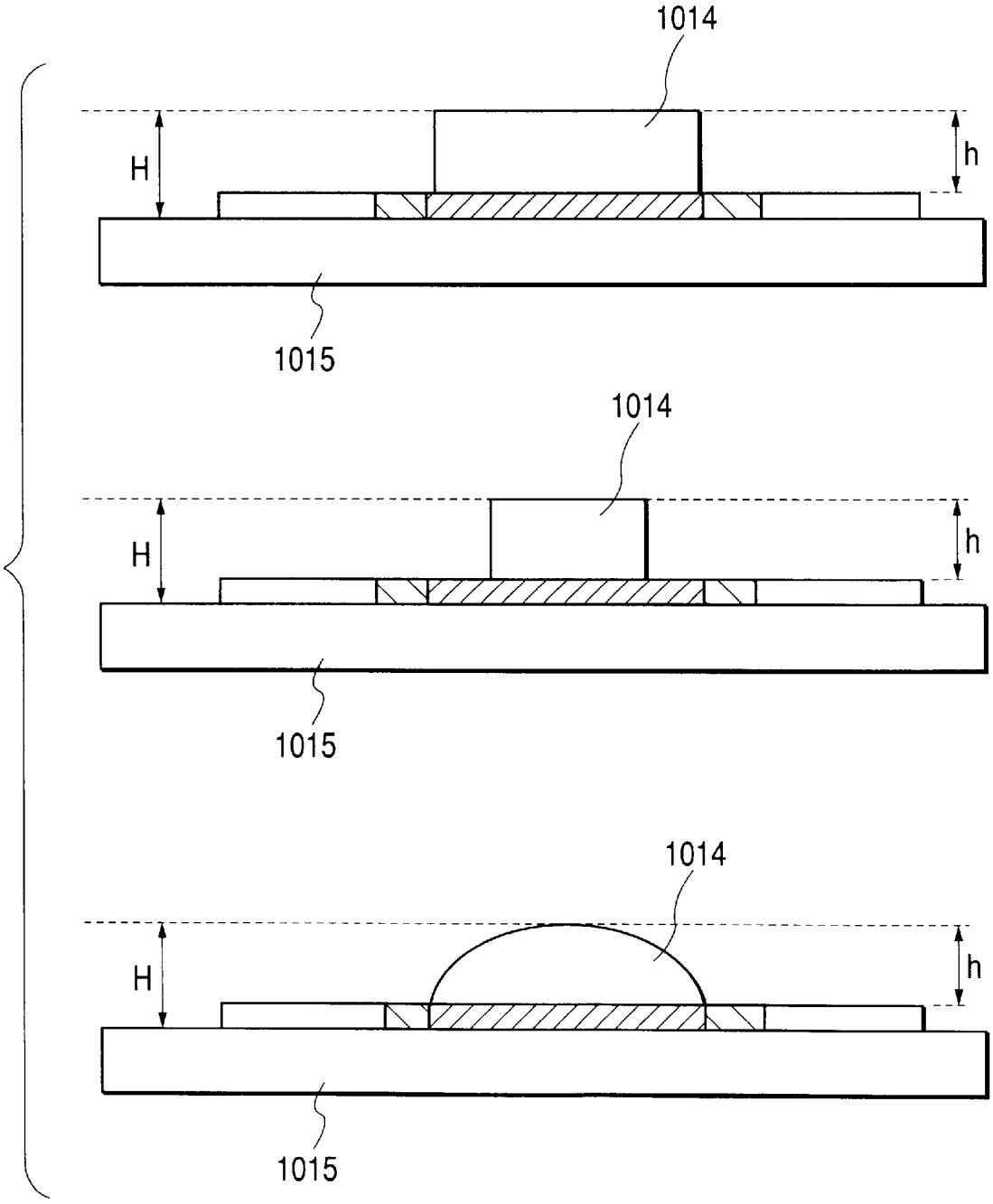
FIG. 5 illustrates variations of a higher voltage electrode.
Figure 18:
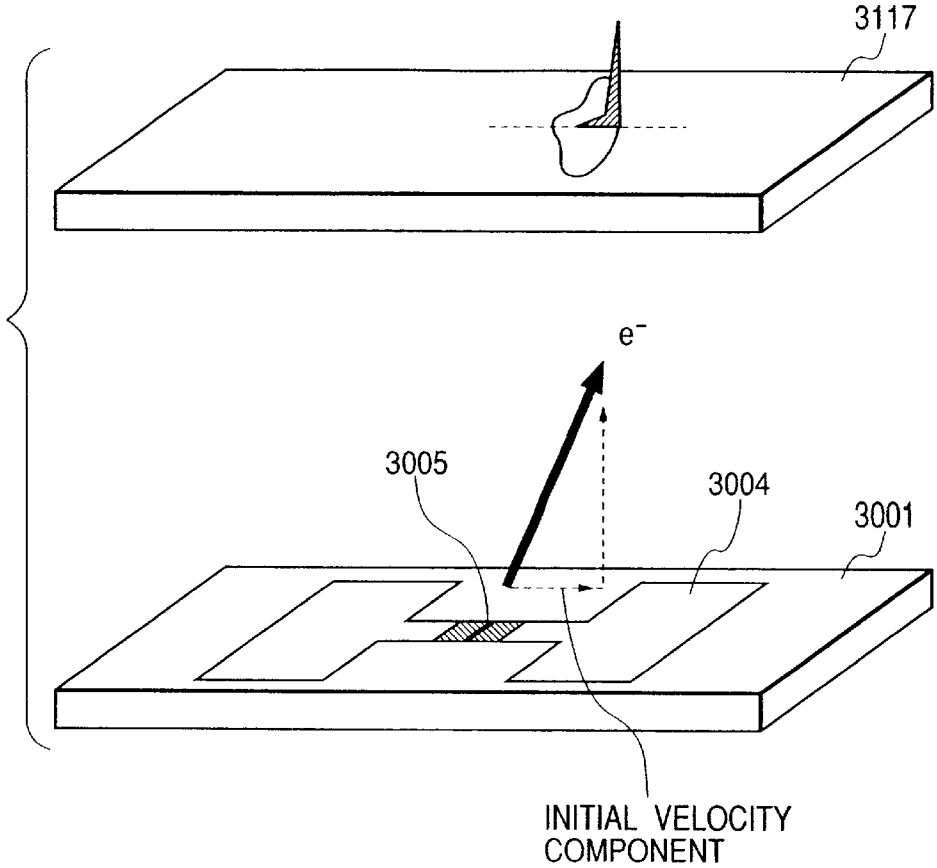
PRIOR ART FIG. 18
FIG. 18 is a schematic perspective view showing an emitted-light pattern of a conventional image display device.
Figure 19:
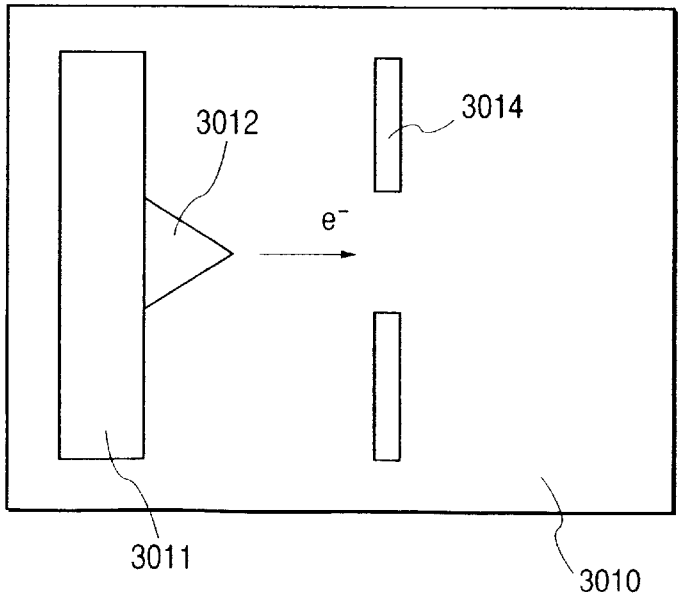
PRIOR ART FIG. 19
FIG. 19 illustrates an example of an FE device (horizontal FE) that is conventionally known.

FIGS. 2 and 3 represent equipotential surface (line) in the vicinity of electron-emitting devices in the cases of (1) and (2), respectively. In addition, for a comparison purpose, FIG. 4 represents a general plane type device, that is, an equipotential surface (line) in the case in which the equipotential surface does not have the structures of (1) and (2) (does not have a structure for forming an electric field for pushing emitted electrons back to the electron-emitting area side). Here, reference symbol Lo ($\mu$m) denotes a curvilinear progression quantity of electron beams. In the case of FIG. 4, since the emitted electrons reach a face plate while maintaining an initial velocity (see FIG. 18), which the emitted electrons have when they are emitted, in a direction other than the direction in which they are directed to the face plate, electron beam spots by electrons emitted from each electron-emitting area of one unit have a relatively large interval. However, in the case of FIGS. 2 and 3, since an electric field for pushing emitted electrons back to the electron-emitting area side is formed, each electron beam spot of one unit can be made closer (cause them to focus). Thus, the structure of the present invention is extremely preferable in obtaining a high definition image display device with a simple configuration.

Figure 8:
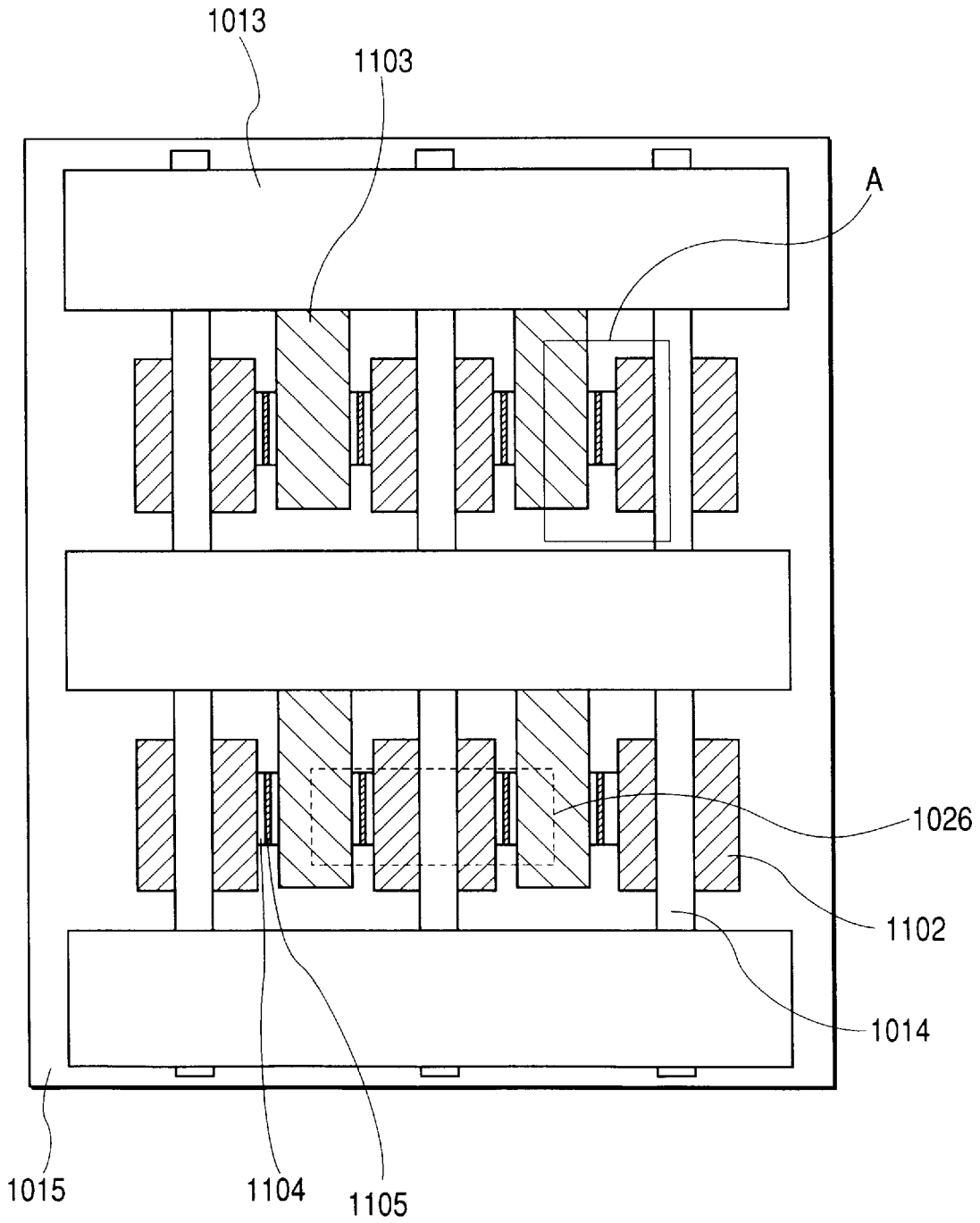
FIG. 8 is a top plan view showing an electron-emitting device in accordance with the embodiment mode of the present invention.

Further, here, the higher voltage electrode and the lower voltage electrode mean electrodes to which a high voltage and a low voltage are respectively applied, which exist within an area (area 1026 as shown in FIG. 8) that is obtained by extending an area provided with electron-emitting areas within one unit in the Vf applying direction. More specifically, the higher voltage electrode and the lower voltage electrode mean a device electrode, a wiring electrode and a combination thereof existing within the area. In addition, the height H of the higher voltage electrode and the lower voltage electrode is assumed to be the distance between a top surface of an electrode and a top surface of an electron source substrate. The height h of the part of the higher voltage electrode which is higher than the lower voltage electrode is assumed to be the distance between the top surface of the lower voltage electrode and the top surface of the higher voltage electrode (see FIG. 5).

Figure 6:
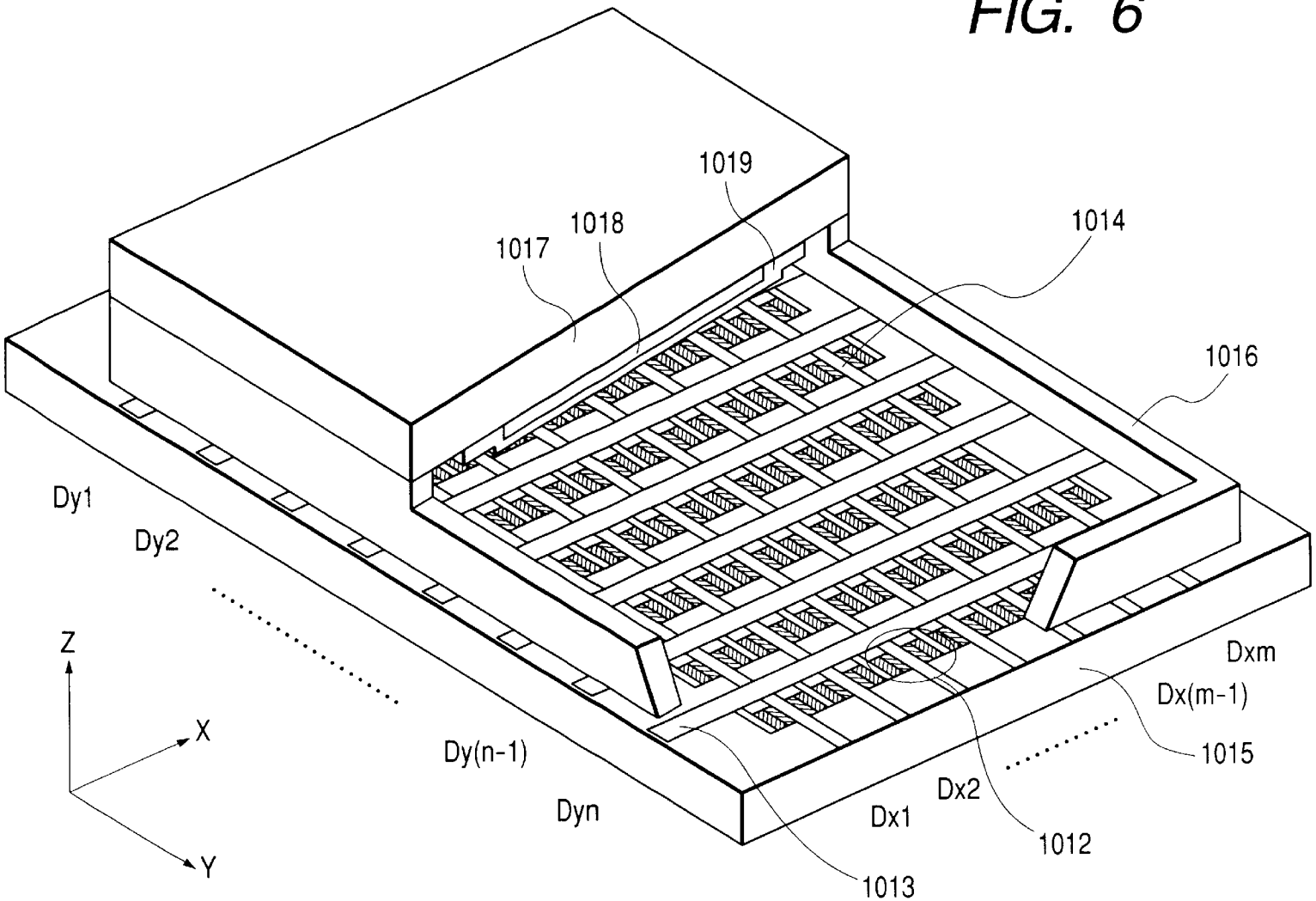
FIG. 6 is a perspective view of a display panel in accordance with the embodiment and a first embodiment of the present invention.

An outline of the image display device of the present invention will be hereinafter described with reference to the drawings. FIGS. 1, 6 and 8 show an embodiment of the present invention.

In FIG. 6, reference numeral 1015 denotes an electron source substrate (rear plate), which forms a vacuum container with a side wall 1016 and a face plate 1017. On the electron source substrate 1015, there are row-directional wiring 1013 and column-directional wiring 1014 for supplying electricity to surface conduction electron-emitting devices 1012 from the outside of the vacuum container, which are electrically connected to the surface conduction electron-emitting devices 1012. Electron beams emitted from the surface conduction electron-emitting devices 1012 transmit through a metal back 1019 that is an electrode and light-emitting reflection thin-film to which a high voltage is applied, and causes a phosphor 1018 to emit light to display an image.

Figure 14:
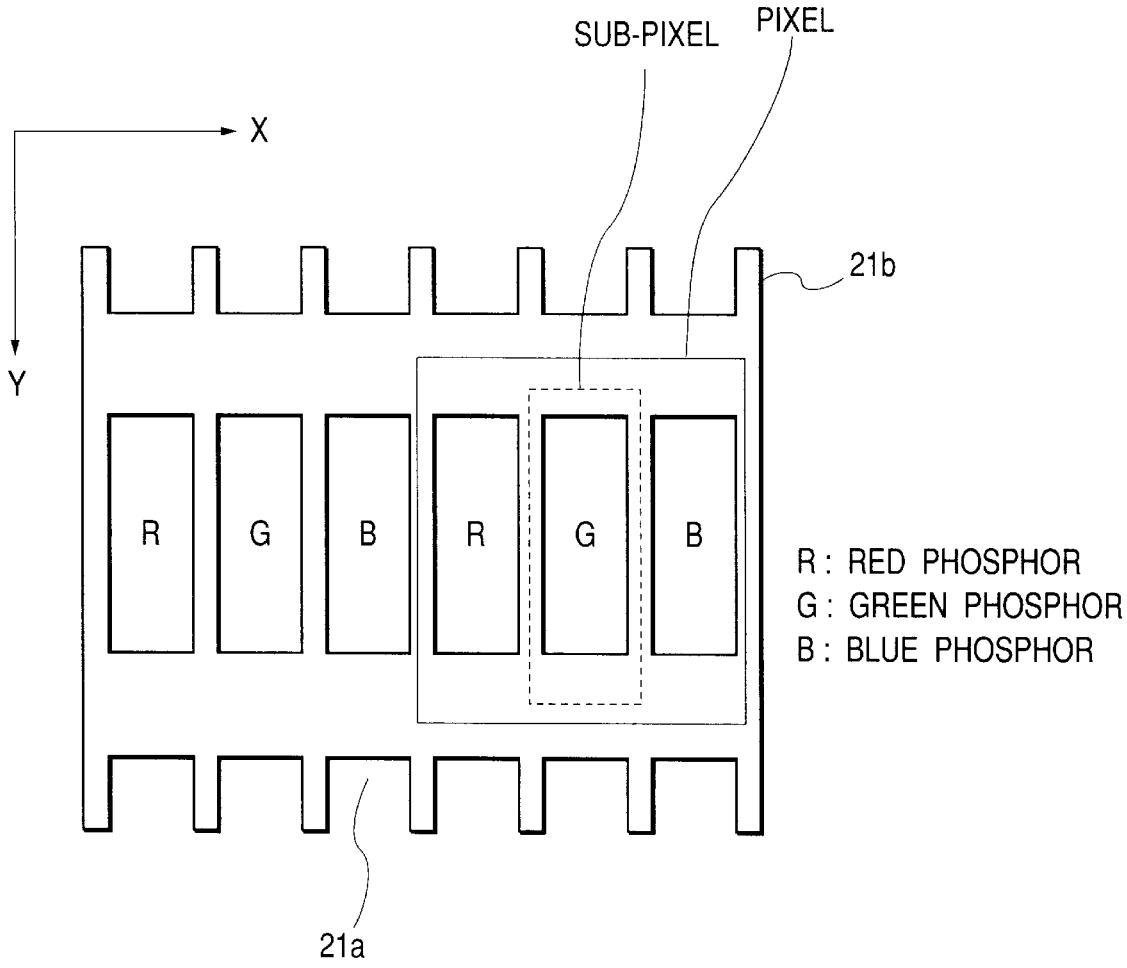
FIG. 14 is a plan view showing a phosphor array on a face place of a display panel used in the embodiments.

Next, a configuration and a focusing action of a surface conduction electron-emitting device having a plurality of emitting area corresponding to one sub-pixel on a face plate having a phosphor that emits light by an impact of an electron beam, which is a characteristic part of the present invention, will be described. Further, one sub-pixel indicates any one of the phosphors that emit light of red (R), green (G) and blue (B), respectively, by an electron beam impact as shown in FIG. 14 (a part surrounded by the dotted lines), and R, G and B phosphors are collectively referred to as one pixel (a part surrounded by the solid lines).

FIG. 1 shows a part of sectional view taken along the line x0–x1 of FIG. 6 and the same members as those in FIG. 6 are denoted by identical reference numerals. An electron-emitting device having electron-emitting areas 1105 in two places shown in 1012 corresponds to one sub-pixel 1018*a* on the face plate 1017, and an emitted-light pattern schematically shown in FIG. 7A is obtained.

Figure 7A:
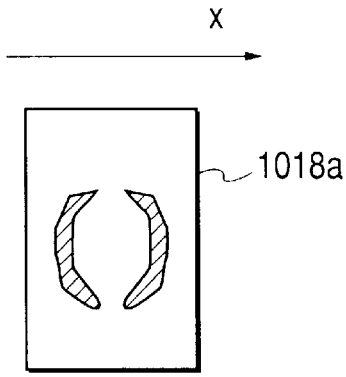
FIG. 7A illustrates an emitted light pattern of an electron beam in accordance with an embodiment of the present invention and FIG. 7B illustrates an example of the configuration of the other electrode-emitting devices according to the present invention.
Figure 7B:
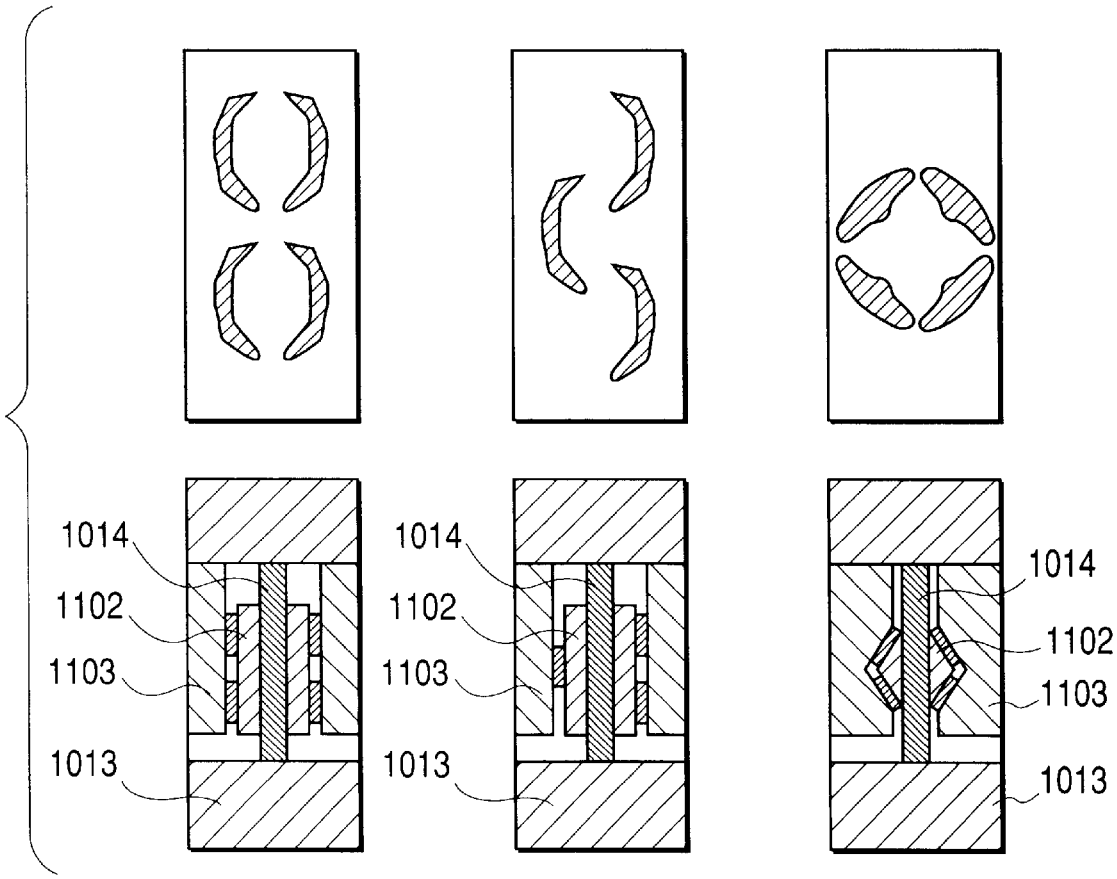

Since light-emitting portions of a plurality of electron beam spots shown in FIG. 7A form one sub-pixel, the life of the phosphor can be significantly increased and the current density saturation of a phosphor can be mitigated to realize an improvement in luminance when compared under the conditions of obtaining predetermined luminance with the conventional case in which light is emitted from only one part. Further, although a plurality of electron beam spots are produced only in the x direction in this embodiment mode, this embodiment mode can be applied to the y direction or the x-y diagonal direction.

Next, the configuration of a surface conduction electron-emitting device, which is an electron source in this embodiment, will be described with reference to FIG. 8. FIG. 8 is a top plan view of the electron source substrate 1015, which can derive an electron beam from the electron-emitting area 1105 by supplying electricity to each of the row-directional wiring 1013 and the column-directional wiring 1014. The electron-emitting area 1105 is produced by applying electron source processing, which will be described later, such as forming and activation to a particulate thin-film 1104. One device (one unit) having a plurality of electron-emitting areas corresponding to one sub-pixel is a part shown by the broken lines 1016.

Next, the configuration of a display panel of an image display device to which the present invention is applied and a method of manufacturing the same will be described with reference to a specific example.

FIG. 6 is a perspective view of a display panel used in this embodiment, which is shown with a part thereof cut away in order to show its internal structure.

In the figure, reference numeral 1015 denotes a rear plate, 1016 denotes a side wall and 1017 denotes a face plate. An airtight container for maintaining a vacuum inside the display panel is formed by the rear plate 1015, the side wall 1016 and the face plate 1017. In assembling the airtight container, it is necessary to seal-bond a junction of each member in order to keep sufficient strength and airtightness of the junction. The seal bonding is realized by applying, for example, frit glass to the junction and baking it for ten minutes or more under the temperature of 400 to 500 degrees Celsius in the atmosphere or the nitrogen atmosphere. A method of exhausting air to evacuate the inside of the airtight container vacuum will be described later. In addition, a vacuum is maintained inside the airtight container at a degree of $133\times10^{-6}$ Pa ($10^{-6}$ Torr).

Next, an electron source substrate that can be used in the image display device of the present invention will be described.

The electron source substrate to be used in the image display device of the present invention is formed by arranging a plurality of cold cathode devices on a substrate.

As an example of a method of arranging cold cathode devices, there is a passive matrix arrangement in which each of X directional wiring and Y directional wiring of a pair of device electrodes in a cold cathode device is connected (hereinafter referred to as a matrix arrangement electron source substrate).

A substrate (not shown) on which N×M cold cathode devices 1012 are formed may be fixed to the rear plate 1015 (N and M are positive integers equal to or larger than 2 and properly set according to a target number of display pixels. For example, in a display device intended to be used as a display of a high definition television, it is desirable to set a number equal to or larger than 3000 as N and a number equal to or larger than 1000 as M). The N×M cold cathode devices are wired in a passive matrix shape by M lines of the row-directional wiring 1013 and N lines of the column-directional wiring 1014. A portion configured by the cold cathode devices 1012, the M lines of the row-directional wiring 1013 and the N lines of the column-directional wiring 1014 is called a multi-electron beam source.

As a method of manufacturing the row-directional wiring 1013 and the column-directional wiring 1014 and an inter-layer insulating layer (not-shown), there are generally known methods such as a screen printing method, a method of exposing and developing a photosensitive thick-film paste, an additive method, a sandblast method, a wet etching method and the like. In this embodiment, since the column-directional wiring 1014 is utilized as a focusing electrode (an electrode pushing emitted electrons back to an electron-emitting area side), a method of exposing and developing a photosensitive thick-film paste, with which relatively high dimensional precision can be obtained, and then baking the photosensitive thick-film is used. Further, the method of manufacturing is not limited to this embodiment but may be the aforementioned methods or other methods.

First, a thick-film photosensitive silver paste was applied to a thickness of 10 $\mu$m by screen printing on the entire surface of the electron source substrate 1015 on which device electrodes (the higher voltage device electrodes 1102 and the lower voltage device electrodes 1103) had already been manufactured. After aligning a photomask of a predetermined pattern, the thick-film photosensitive silver paste was covered by the photomask and exposed to ultraviolet rays under the condition of 300 mj/cm$^2$. Thereafter, the thick-film photosensitive silver paste was water-developed to obtain the pattern of the column-directional wiring 1014 by baking it for 10 minutes at 480° C. Further, the height of the column-directional wiring 1014 can be obtained by repeating the above-mentioned process several times.

The thick-film photosensitive insulating paste was also applied to a thickness of 20 $\mu$m by screen printing on the entire surface, water-developed and baked after exposure by a photomask to obtain the insulating layer. Conditions of exposure and baking are the same as those for the column-directional wiring 1014, and the exposure and baking are repeated several times.

Finally, with regard to the row-directional wiring 1013, on the entire surface a photosensitive silver paste was applied to a thickness of 10 $\mu$m by screen printing and, after aligning a photomask of a predetermined pattern, was covered by the photomask and exposed to ultraviolet rays under the condition of 300 mj/cm$^2$. Thereafter, it was water-developed to obtain the pattern of the row-directional wiring 1013 by baking it for 10 minutes at 480° C. Further, since the requisite dimensional precision for the row-directional wiring 1013 is lower compared with the column-directional wiring 1014, the row-directional wiring 1013 may be subject to a predetermined patterning by screen printing.

Next, a structure of a multi-electron beam source that is formed by arranging the surface conduction electron-emitting devices 1012 on a substrate as cold cathode devices and subjected them to a passive matrix wiring will be described.

FIG. 8 is a plan view of a multi-electron beam source used in the display panel of FIG. 6. On the substrate 1015, a plurality of devices are wired in a passive matrix shape by the row-directional wiring 1013 and the column-directional wiring 1014. Insulating layers (not shown) are formed among electrodes in the parts where the row-directional wiring 1013 and the column-directional wiring 1014 crosses, whereby electrical insulation is kept.

Further, the multi-electron beam source of such a structure is manufactured by forming on the substrate the row-directional wiring 1013, the column-directional wiring 1014 and inter-electrode insulating layers (not shown) as well as the device electrodes of the surface conduction electron-emitting devices (the higher voltage device electrodes 1102 and the lower voltage device electrodes 1103) and the electro conductive thin films 1104 in advance and then supplying electricity to each device via the row-directional wiring 1013 and the column-directional wiring 1014 to apply energization forming operation and energization activation operation to them.

Figure 15:
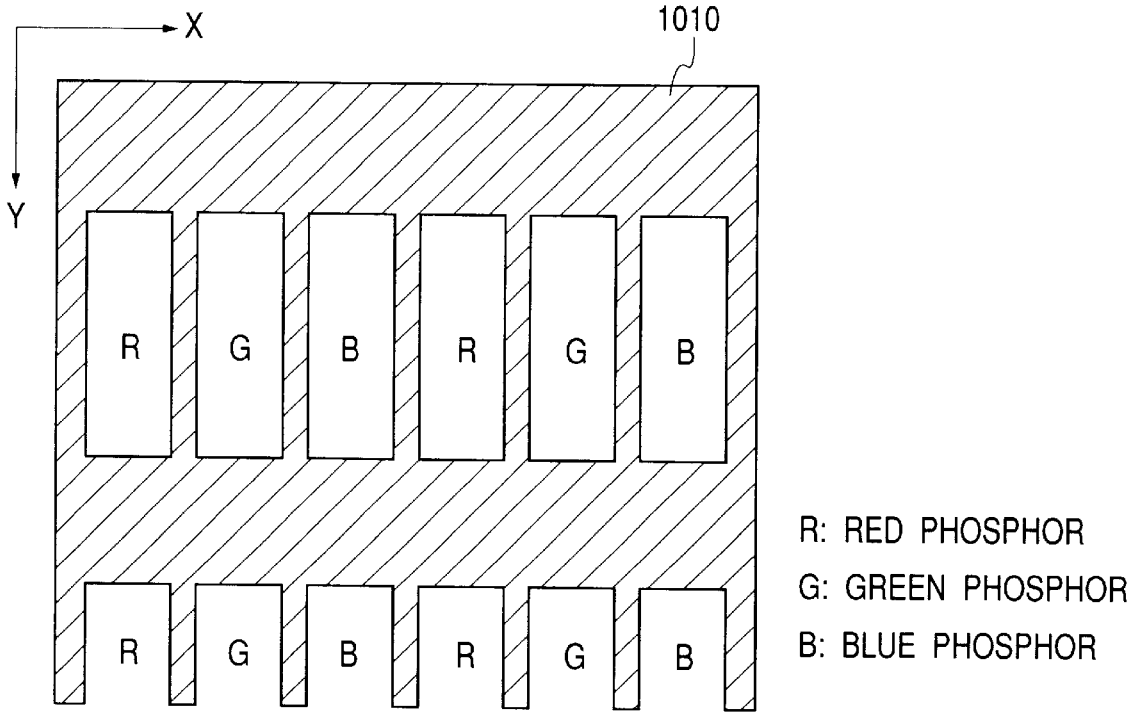
FIG. 15 is a plan view illustrating a phosphor array on a face plate of a display panel.

In addition, the fluorescent film 1018 is formed on the lower surface of the face plate 1017. Since this embodiment relates to a color display device, phosphors of three primary colors of red (R), green (G) and blue (B), which are used in the field of CRT, are arranged in the parts of the fluorescent film 1018. The phosphors of the respective colors are arranged, for example, in a stripe shape as shown in FIG. 15 and black conductor 1010 is provided among the stripes of phosphors. The purpose of providing the black conductor 1010 is to prevent a displayed color from deviating even if the irradiating position of an electron beam deviates more or less, to prevent reflection of external light to eliminate degradation of a display contrast, to prevent charge-up of a luminescent film due to an electron beam, and the like. Although graphite is used as a main component in the black conductor 1010, any other material may be used as long as it meets the above-mentioned requirements.

In addition, the method of arranging the phosphors of the three primary colors is not limited to the arrangement in the stripe shape shown in FIG. 15.

Further, if a monochrome display panel is manufactured, it is sufficient to use a monochrome phosphor material for the fluorescent film 1018 and a black conductor material may not always be used.

In addition, the metal back 1019 that is well known in the field of CRT is provided on the surface of the fluorescent film 1018 on the rear plate side. The purpose of providing the metal back 1019 is to mirror-reflect a part of light emitted from the fluorescent film 1018 to improve a light-use ratio, to protect the fluorescent film 1018 from collision of negative ions, to cause it to act as an electrode for applying an electron beam accelerating voltage, to cause the fluorescent film 1018 to act as an electro conductive path for excited electrons, and the like. The metal back 1019 is formed by a method of forming the fluorescent film 1018 on the face plate substrate 1017, and then applying the smoothing processing to the surface of the fluorescent film 1018 and vacuum-evaporating Al thereon. Further, if a phosphor material for a low voltage is used for the fluorescent film 1018, the metal back 1019 is not used.

In addition, a transparent electrode made of, for example, ITO may be provided between the face plate substrate 1017 and the fluorescent film 1018 for the purpose of applying an acceleration voltage and improving conductivity of a luminescent film, although it is not used in this embodiment.

In addition, Dx1 to Dxm, Dy1 to Dyn and Hv are electrical connection terminal of an airtight structure, which are provided for electrically connecting the display panel and an electric circuit (not shown). Dx1 to Dxm, Dy1 to Dyn and Hv are electrically connected to the row-directional wiring 1013 of the multi-electron beam source, the column-directional wiring 1014 of the multi-electron beam source and the metal back 1019 of the face plate, respectively.

In addition, in order to exhaust air to evacuate the inside of an airtight container, after the airtight container is assembled, an exhaust pipe (not shown) and a vacuum pump are connected to exhaust air from the inside of the airtight container to the vacuum degree in the order of $133\times10^{-7}$ Pa ($10^{-7}$ Torr). Thereafter, although the exhaust pipe is sealed, a getter film (not shown) is formed in a predetermined position within the airtight container immediately before the sealing or after the sealing in order to maintain the vacuum degree inside the airtight container. The getter film is a film that is formed by heating a getter material containing, for example, Ba as a main component by a heater or high-frequency heating to evaporate it. The inside of the airtight container is maintained at the vacuum degree of $133\times10^{-5}$ Pa to $133\times10^{-7}$ Pa ($1\times10^{-5}$ to $1\times10^{-7}$ Torr) by the attracting action of the getter film.

In the image display device using the display panel described above, when a voltage is applied to each cold cathode device 1012 through the terminals Dx1 to Dxm and Dy1 to Dyn which are arranged outside the container, electrons are emitted from each cold cathode device 1012. A high voltage in the range from several hundreds of V to several kV is simultaneously applied to the metal back 1019 through the terminal Hv which is arranged outside the container to accelerate the emitted electrons and cause them to collide against the internal surface of the face plate 1017. Consequently, the phosphors of each color forming the fluorescent film 1018 are excited to emit light and an image is displayed.

Normally, a voltage applied to the surface conduction electron-emitting devices 1012, which are cold cathode devices, is in the order of 12 to 16 V, a distance d between the metal back 1019 and the cold cathode devices 1012 is in the order of 0.1 to 8 mm and a voltage between the metal back 1019 and the cold cathode devices 1012 is in the order of 0.1 to 10 kV.

Embodiments

The present invention will be hereinafter described in more detail with reference to embodiments. However, the present invention is not limited to these embodiments.

In each embodiment to be described below, a multi-electron beam source in which N×M (N=3072, M=1024) surface conduction electron-emitting devices, which was the type having electron-emitting areas on the above-mentioned electro conductive particulate film among electrodes, were subjected to a matrix wiring (see FIG. 6) by M lines of row-directional wrings and N lines of column-directional wrings were used as a multi-electron beam source.

First Embodiment

Figure 12:
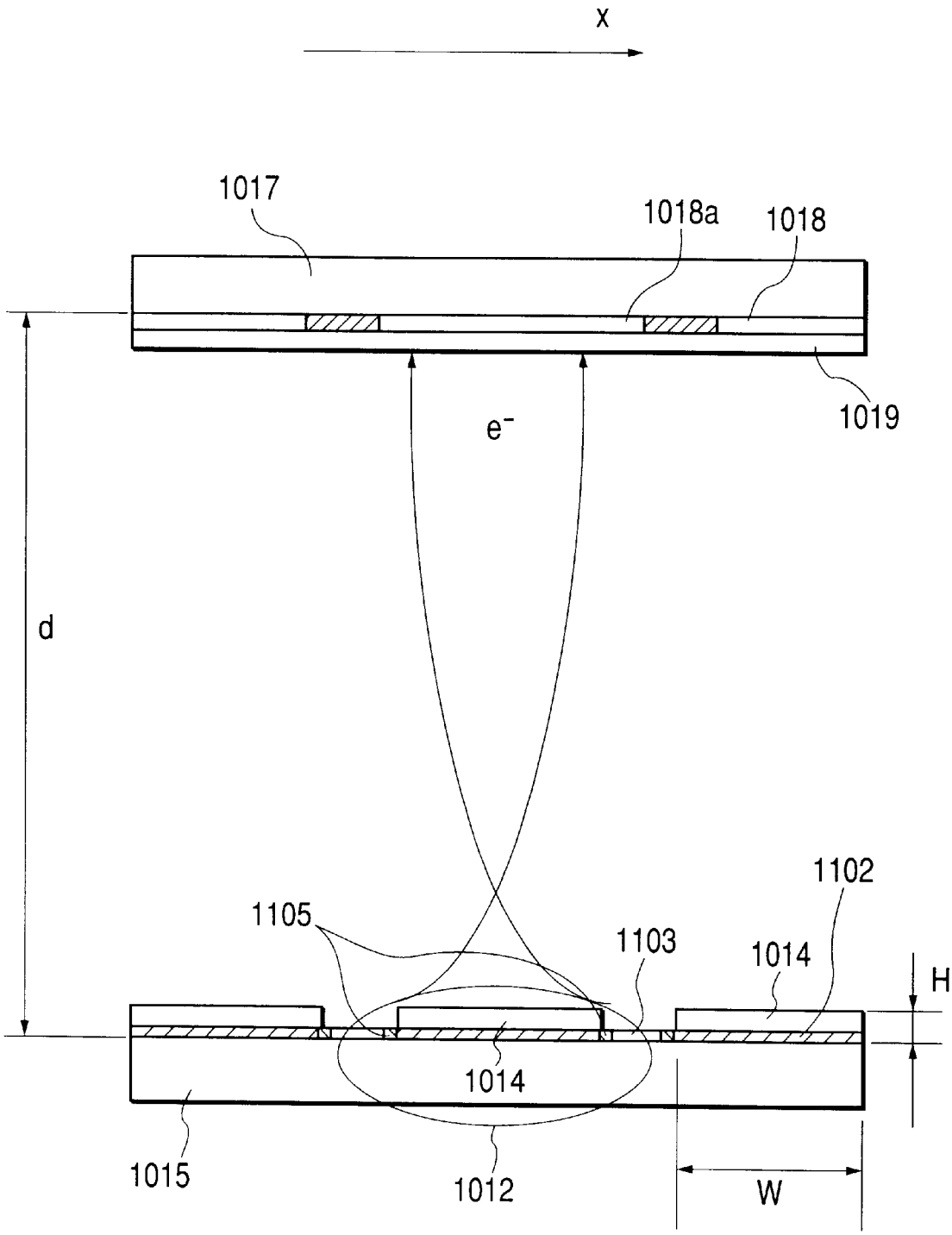
FIG. 12 illustrates the first embodiment of the present invention.

A first embodiment of the present invention will be hereinafter described based on the drawings. An image display device shown in FIG. 6 was manufactured using the method described in detail in the above-mentioned embodiment, a partial enlarged view of which is shown in FIG. 12. Further, the higher voltage device electrode 1102 was first formed by vacuum evaporation method and then was formed by photolithography and etching and thereafter, the column-directional wiring 1014 was formed by screen printing of a thick-film photosensitive paste and exposure, development and baking of the column-directional wiring 1014 were repeated several times, whereby the higher voltage electrode (the higher voltage device electrode 1102 and the row-directional wiring 1014), which is a characteristic part of the present invention, was manufactured with a desired height.

The higher voltage electrode manufactured as described above was formed higher compared with the lower voltage electrode (the lower voltage device electrode 1103) as shown in FIG. 12. More specifically, the height of the lower voltage electrode (the lower voltage device electrode 1103) was 0.2 ($\mu$m) and the height H of the higher voltage electrode (the higher voltage device electrode 1102+the column-directional wiring 1014) was 16 ($\mu$m).

Consequently, since emitted electrons were pushed back to the electron-emitting area 1105 side, electron beams focused and a luminescence spot shape of high definition with suppressed degradation of a phosphor was obtained.

Second Embodiment

Figure 13:
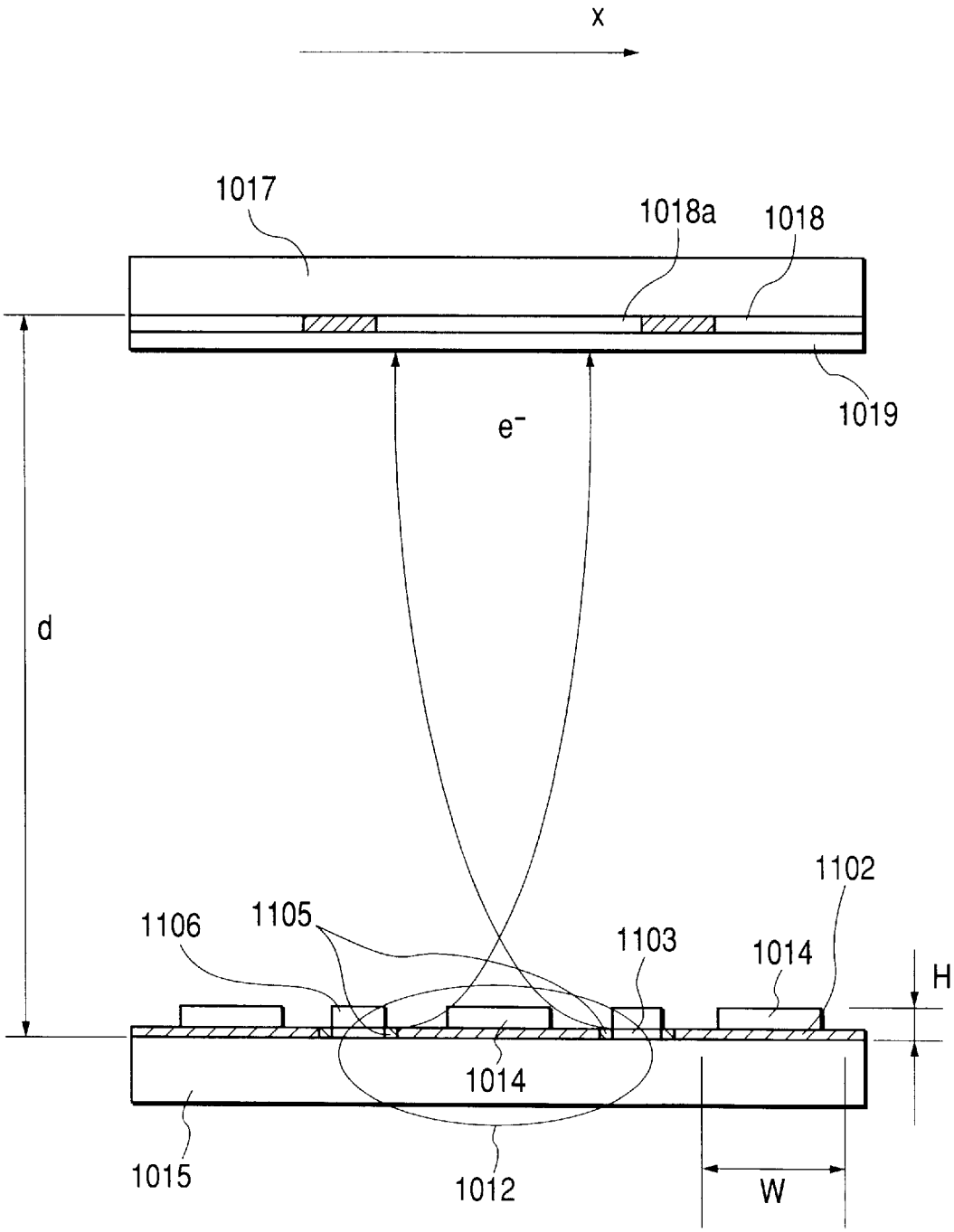
FIG. 13 illustrates a second embodiment of the present invention.

In this embodiment, a display device was manufactured in the same manner as in the first embodiment except that a step was formed by the higher voltage device electrode 1102 and the column-directional wiring 1014 and the height of the higher voltage electrode (the higher voltage device electrode 1102 and the column-directional wiring 1014) and the height of the lower voltage electrode (the lower voltage device electrode 1103) were made identical. Its partial enlarged view is shown in FIG. 13.

In this embodiment, the height H of the higher voltage electrode and the lower voltage electrode was 16 $\mu$m. The device electrodes (the higher voltage device electrode 1102 and the lower voltage device electrode 1103) of 0.2 $\mu$m were formed by the evaporation method and then a thick-film photosensitive silver paste was applied to a thickness of 16 $\mu$m by screen printing and exposed, whereby the column-directional wiring 1014 and the electrode 1106 above the lower voltage device electrode 1103 were formed.

Thereafter, as in the above-mentioned embodiment, an insulating layer and a row wiring electrode were formed.

Consequently, since emitted electrons were pushed back to the electron-emitting area 1105 side, electron beams focused and a luminescence spot shape of high definition with suppressed degradation of a phosphor was obtained.

Third Embodiment

Figure 16:
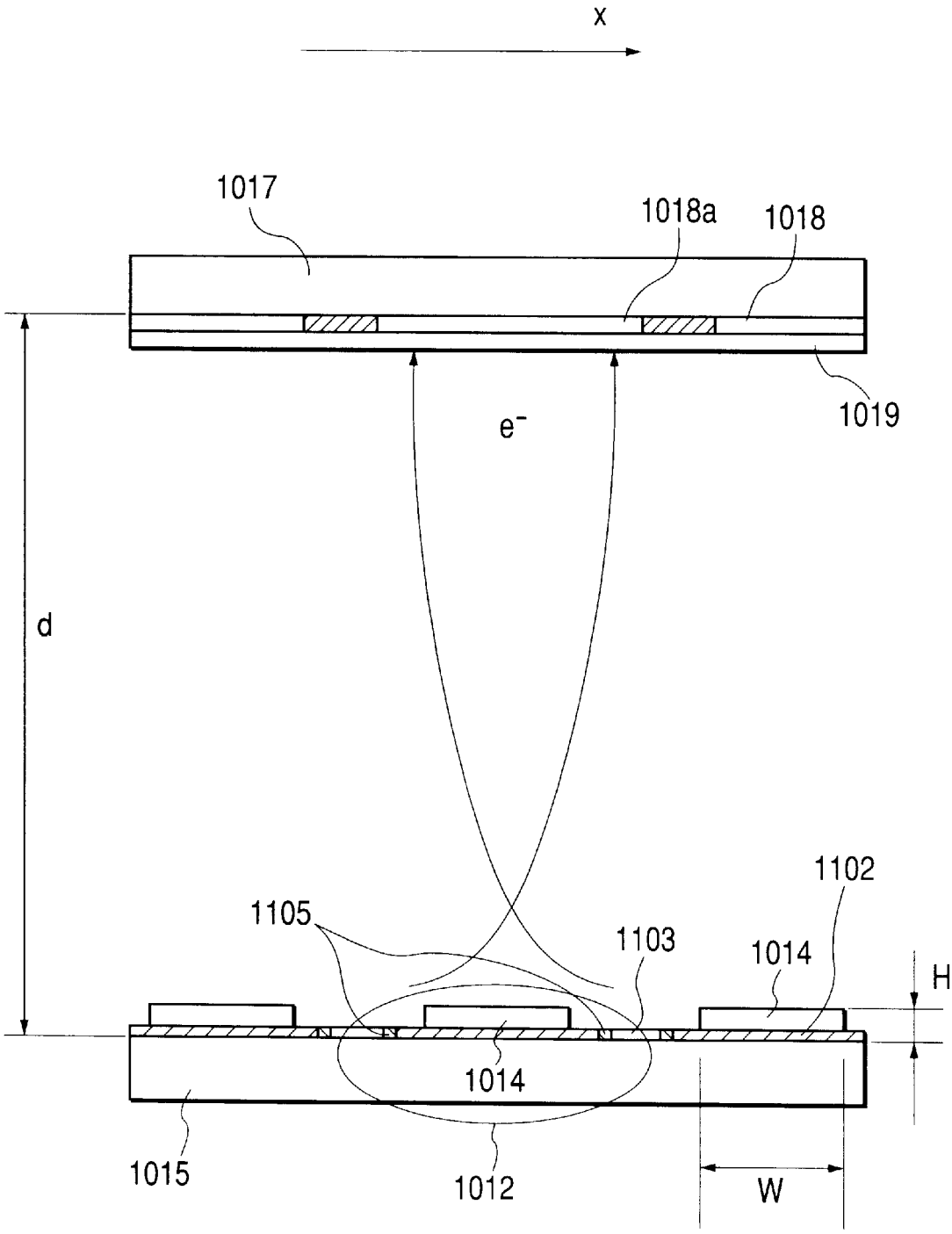
FIG. 16 illustrates a third embodiment of the present invention.
Figure 17:
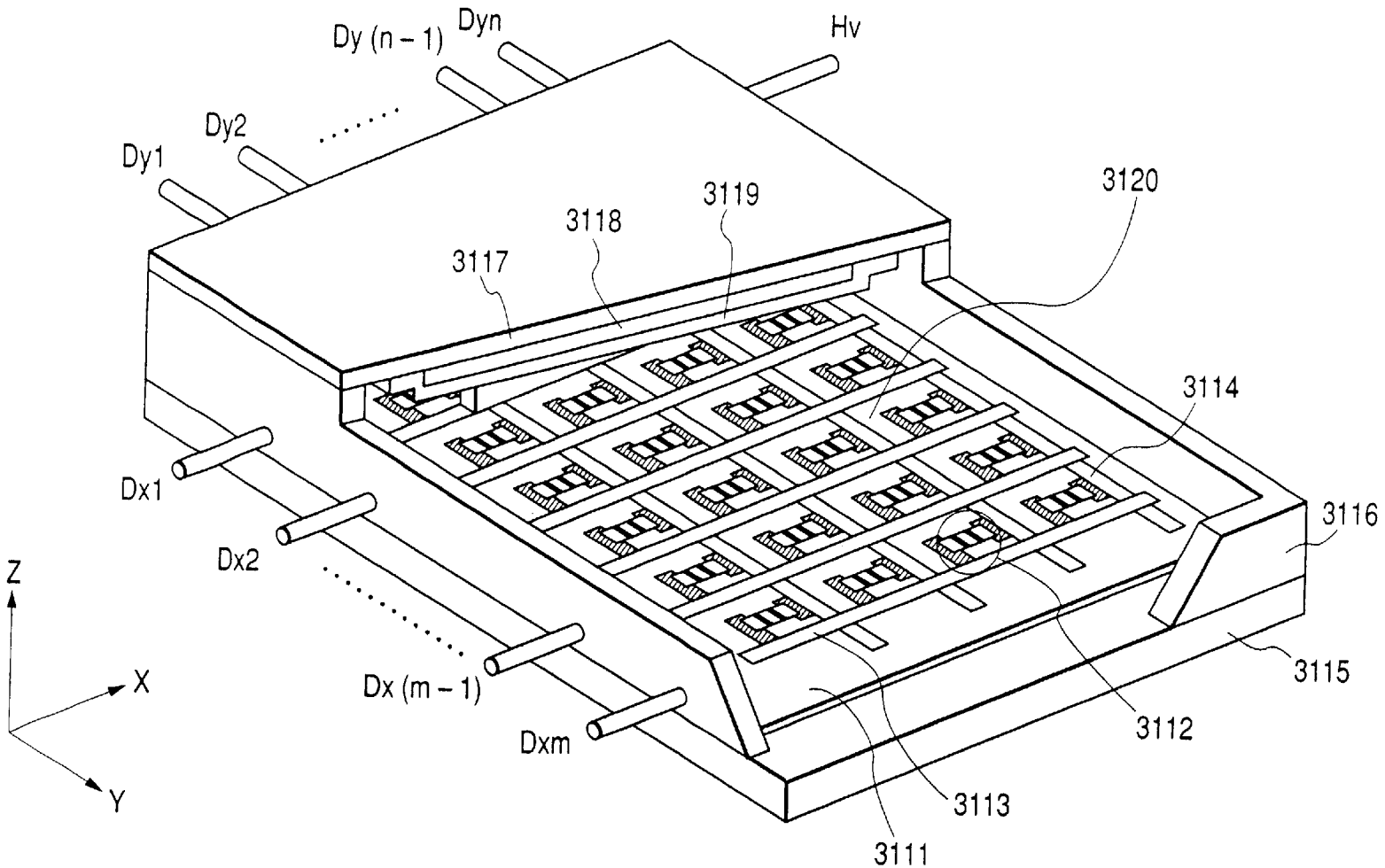
PRIOR ART FIG. 17
FIG. 17 is a schematic view of a conventional panel.

In this embodiment, a display device was manufactured in the same manner as in the first embodiment except that the higher voltage electrode (the higher voltage device electrode 1102 and the column-directional wiring 1014) were made higher than the lower voltage electrode (the lower voltage device electrode 1103) and a step was formed by the higher voltage device electrode 1102 and the column-directional wiring 1014. More specifically, the width of the column-directional wiring 1014 of the first embodiment was made narrower than the width of the higher voltage device electrode 1102, whereby the shape of this embodiment was obtained. Its partial enlarged view is shown in FIG. 16.

Consequently, since emitted electrons were pushed back to the electron-emitting area 1105 side, electron beams focused and a luminescence spot shape of high definition with suppressed degradation of a phosphor was obtained.

Fourth Embodiment

In this embodiment, a more preferable form as a shape of the higher voltage electrode will be described with reference to a case in which the higher voltage electrode (the higher voltage device electrode 1102 and the column-directional wiring 1014) has a part higher than the lower voltage electrode (the lower voltage device electrode 1103) as shown in FIG. 1.

As in the first embodiment, in an image display device using the display panel shown in FIG. 6, a scanning signal and a modulation signal were applied to each cold cathode device (surface conduction electron-emitting device) 1012, respectively, through the terminal Dx1 to Dxm and Dy1 to Dyn which are arranged outside the container to cause the cold cathode device to emit electrons and a high voltage was applied to the metal back 1019 through the high voltage terminal Hv (not shown) to accelerate emitted electron beams and cause the electrons to collide against the fluorescent film 1018, whereby the phosphors of each color were excited and emitted light to display an image. Further, the voltage Va applied to the high voltage terminal Hv was in the range of 3 kV to 10 kV and the voltage Vf applied to a part between the wirings 1013 and 1014 was in the range of 0 V and 14 V, respectively.

An emitted-light pattern of the image display device of this embodiment is shown in FIG. 7A. FIG. 7A shows the case in which the width W of the part of the higher voltage electrode which is higher than the surface of the lower voltage electrode (width of the column-directional wiring 1014) is 60 $\mu$m and the height h of the higher voltage electrode from the surface of the lower voltage electrode (height of the column-directional wiring 1014) is 16 $\mu$m, and a potential difference Va between an anode electrode and the lower voltage electrode (applied voltage of the face plate) is 10 kV. It was confirmed that one sub-pixel consisted of two electron beam patterns. A luminance of one sub-pixel was approximately twice as large as that of conventional one sub-pixel composed of one electron beam pattern. That is, the effect of the present invention could be confirmed in that, when the same luminance as in the prior art was obtained, a charge density to be applied to one sub-pixel was reduced by fifty percent and the Coulomb degradation of a phosphor was significantly reduced.

Figure 9:
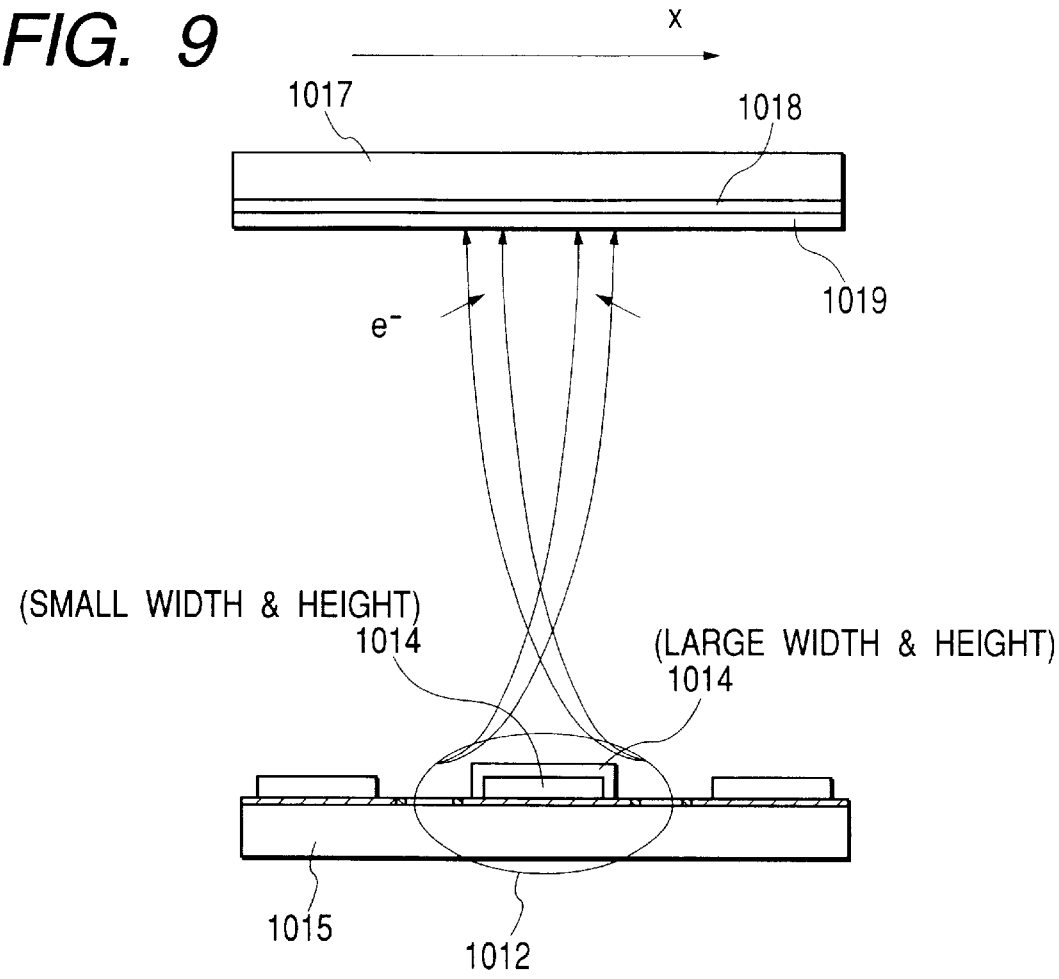
FIG. 9 illustrates a state of focusing by a wiring electrode in accordance with the embodiment mode of the present invention.
Figure 10:
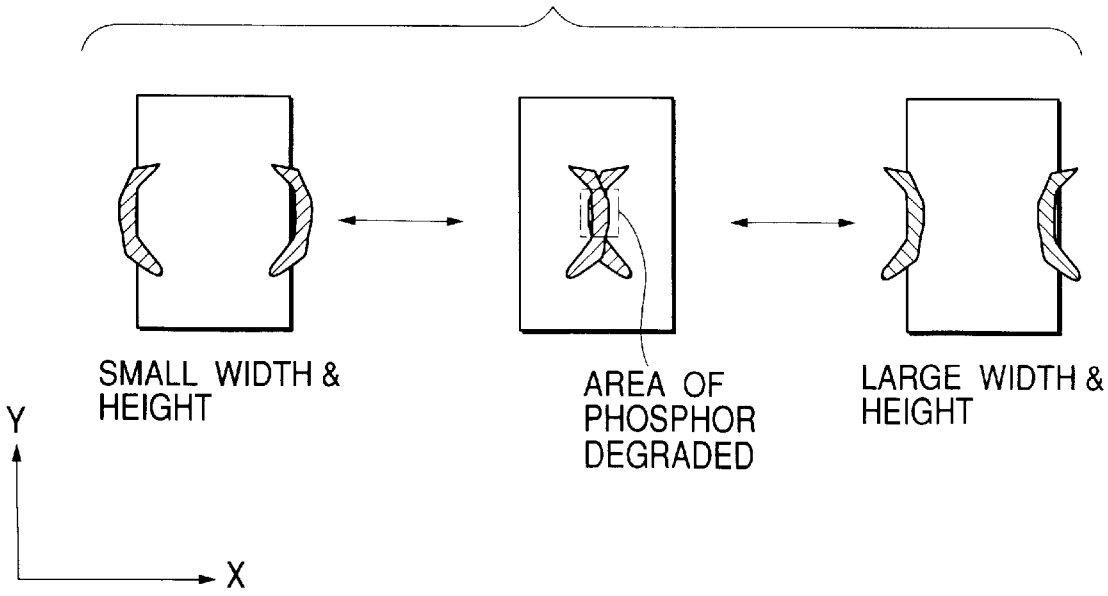
FIG. 10 illustrates emitted-light patterns by wiring electrode in accordance with the embodiment mode of the present invention.

The width W and the height h of the column-directional wiring 1014 were changed to observe an emitted-light pattern by electron beams. As a result of the observation, it was confirmed that, as the width W and the height h increased and electron beams proceeded to the top surface (surface on the face plate side) side of the column-directional wiring 1014, since the electron beams were repulsed (a force pushing back the electron beams to the electron-emitting area side acted in the x direction) as shown in FIG. 9, the electron beams acted in the direction of focusing. That is, it was found that, as shown in FIG. 10, if the width W and the height h of the column-directional wiring 1014 were too small, the electron beams spreads too broader to collide against or reach the desired phosphors and, on the other hand, if the width W and the height h were too large, the electron beams partially overlapped and the effect of improving degradation of a phosphor and luminance saturation was reduced (as shown in FIG. 10, the spot shape of the electron beams emitted from each electron-emitting area never overlap completely. Thus, since a phosphor degradation area is smaller compared with that of an electron-emitting device consisting of one emitting area, the degradation of a phosphor does not affect the image so much. However, it is preferable that electron beams do not overlap. Since focusing of electron beams is suitable for making a display panel high definition, although the focusing is not unconditionally bad, it is not preferable in terms of the degradation of a phosphor if deviation of a current density distribution is too large. In addition, if the column-directional wiring 1014 becomes higher, the electron beam spot spreads conversely.

As a result of various examinations, it was found that, when giving the focusing effect of electron beams to the column-directional wiring 1014, it was preferable that the height h ($\mu$m) of the higher voltage electrode from the surface of the lower voltage electrode (the height of the column-directional wiring 1014) met the following expression (1) when the interval between the substrate and the anode electrode provided on the display member was d ($\mu$m), the potential difference between the higher voltage electrode and the lower voltage electrode (the potential difference applied to among electron-emitting areas) was Vf (V), and the potential difference between the anode electrode and the lower voltage electrode (the acceleration voltage applied to the anode electrode) was Va (V).

$$(Va/d)\times\beta h>Vf \quad (1).$$

If the focusing was excessive and two electron beams overlapped in an identical place, the effect of preventing the degradation of a phosphor was reduced, which was not preferable. It was found that a conditional expression in this case was as follows when the pitch width of one unit (one unit width) in the directions of higher voltage electrode and lower voltage electrode (x direction) was Px ($\mu$m) and the distance from the electron-emitting areas to the one unit end was $\Delta$Px ($\mu$m).

$$h<(A+(B\times In(2Lo/(Px-2\Delta Px)))^{0.5})/\beta \quad (2).$$

Here, A is represented by the following expression with the width W ($\mu$m) of the part of the higher voltage electrode which is higher than the surface of the lower voltage electrode (the width of the column-directional wiring 1014) used as a parameter.

$$A=-0.5\alpha W+26.2$$

Lo ($\mu$m) is a curvilinear progression quantity of electron beams of the general plane type device shown in FIG. 4 and is represented by the following expression.

$$Lo=2Kd(Vf/Va)^{0.5}$$

K is a constant in the order of 0.8 to 1.2 and depends on positions of electron-emitting areas produced by forming. In addition, B is a constant in the order of 900.

In addition, $\alpha$ and $\beta$ are correction factors depending on a shape of the higher voltage electrode. In this embodiment, both $\alpha$ and $\beta$ are 1 because the electrode shape is substantially rectangular.

The above-mentioned relational expression (2) means that the interval D ($\mu$m) in the part where the current density is large shown in FIG. 1 is larger than zero. D is represented by the following expression.

$$D=2L-(Px-2\Delta Px)$$

$$L=LoExp(-(\beta h-A)2/B)$$

D>0 is a condition that the parts where the current density is large are not overlapped with each other, which makes it possible to prevent degradation of a phosphor.

Further, in this embodiment, Va=10 kV, Vf=15 V, d=2000 $\mu$m, Px=205 $\mu$m and $\Delta$Px=35 $\mu$m.

Consequently, it is possible to cause electron beams to focus while suppressing the degradation of a phosphor with a simple configuration and, at the same time, a high density and high definition display device can be provided. That is, focusing of electron beams is attained without separately providing a focusing electrode and without providing a special interval (space) of electron-emitting areas or the like for overlapping electron beams.

Fifth Embodiment

This embodiment provides an example in which the higher voltage electrode (higher voltage device electrode 1102 and the column-directional wiring 1014) has a part higher than the lower voltage electrode (lower voltage device electrode 1103) as in the fourth embodiment. However, the part of the higher voltage electrode (column-directional wiring 1014) higher than the lower voltage electrode is not rectangular as in the fourth embodiment.

An image display device shown in FIG. 6 to be used in this embodiment was manufactured as described below.

As indicated in the embodiment, a device electrode was formed on a soda lime glass substrate by vacuum evaporation method and then a desired patterning was applied to it by photolithography and etching. Next, the column-directional wiring 1014, the inter-layer insulating layer (not shown) and the row-directional wiring 1013 were manufactured in this order.

Figure 11:
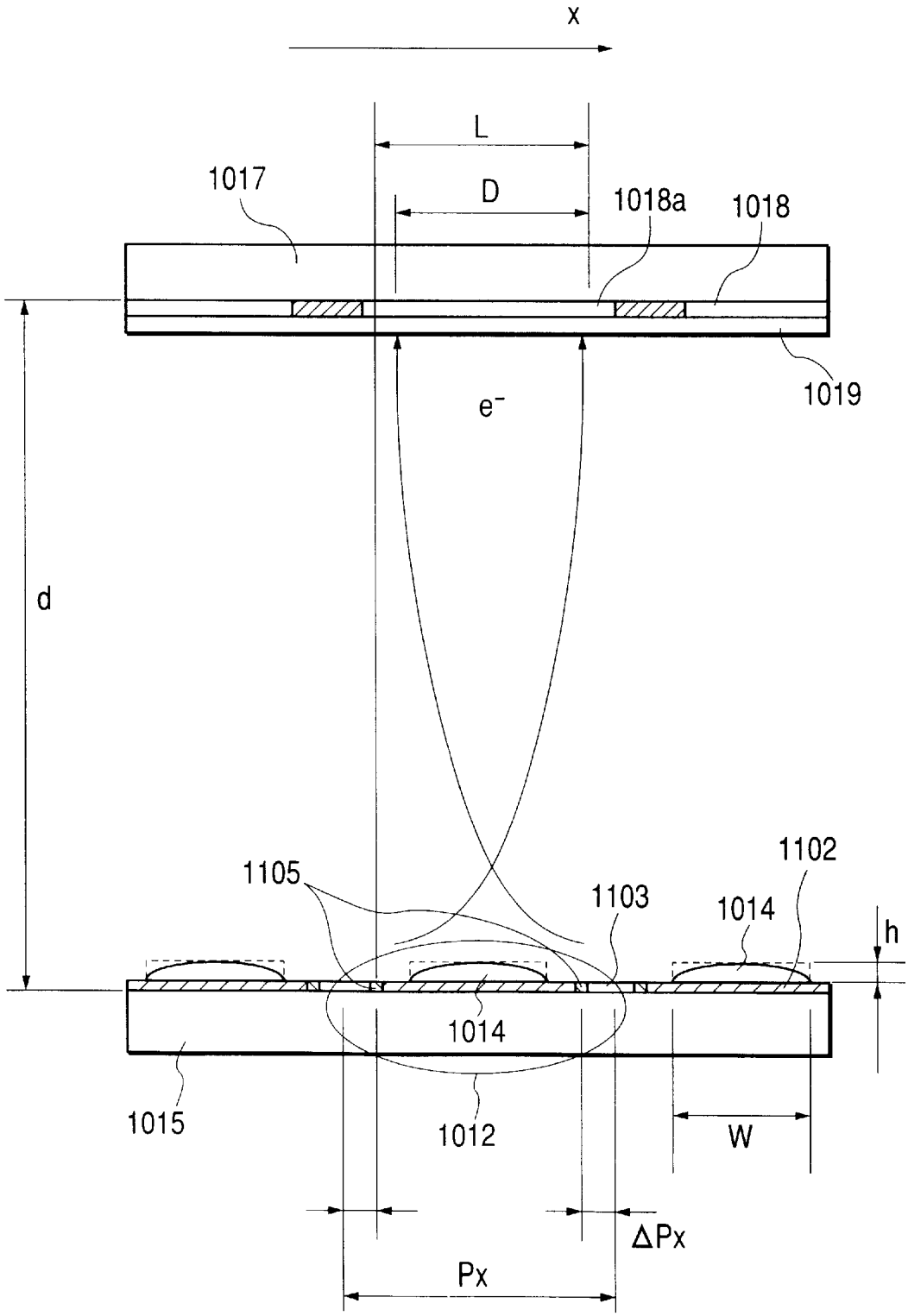
FIG. 11 illustrates a fifth embodiment of the present invention.

The fifth embodiment is different from the fourth embodiment in that the column-directional wiring 1014 and the inter-layer insulating layer were manufactured by screen printing of a thick-film silver paste. The column-directional wiring 1014 had a cross sectional shape as shown by solid lines in FIG. 11. Further, the width W and the height h of the column-directional wiring 1014 were varied. Here, as shown in FIG. 11 it was assumed that the width W and the height h of the column-directional wiring 1014 were defined by a dimension of an edge portion of the wiring, that is, a rectangle (broken lines) containing the wiring.

The surface conduction electron-emitting device 1012 was manufactured by applying a particulate film of PdO and applying predetermined patterning.

An emitted-light pattern of the image display device manufactured as described above is shown in FIG. 7A. FIG. 7A shows the case in which the width W and the height h of the column-directional wiring 1014 are 45 $\mu$m and 16 $\mu$m, respectively, and the potential difference Va between the anode electrode and the lower voltage electrode (applied voltage of the face plate) is 10 kV. It was confirmed that one sub-pixel consisted of two electron beam patterns and that a luminance was improved by several % to several tens % if an amount of charges applied to one sub-pixel was equal compared with that of conventional one sub-pixel composed of one electron beam pattern. That is, the effect of the present invention was confirmed in that, if the same luminance as in the prior art was obtained, the charge density to be applied to one sub-pixel was reduced by fifty percent or more and the Coulomb degradation of the phosphor was significantly reduced.

Here, the shape of the higher voltage electrode of this embodiment will be described in detail.

As a result of various examinations, it was found that, when giving the focusing effect of electron beams to the column-directional wiring 1014, it was preferable that the height h ($\mu$m) of the column-directional wiring 1014 met the relational expression (1) indicated in the fourth embodiment. However, $\beta$ was a correction parameter of a cross sectional shape in the height direction of the column-directional wiring 1014 and was a value in the range of 0.8 to 1.0, depending on a shape. In this embodiment, it was assumed to be 0.9.

If the focusing was excessive and two electron beams overlapped in an identical place, the electron beams accelerated the degradation of a phosphor, which was not preferable. It was found that a conditional expression in this case was the relational expression (1) indicated in the fourth embodiment. However, $\alpha$ was a correction parameter of a cross sectional shape in the width direction of the column-directional wiring 1014 and was a value in the range of 0.8 to 1.0, depending on a shape. In this embodiment, it was assumed to be 0.9.

Similarly to the fourth embodiment, the above-mentioned relational expression (2) means that the interval D ($\mu$m) in the part where the current density is large shown in FIG. 1 is larger than zero. D is represented by the following expression.

$$D=2L-(Px-2\Delta Px)$$

$$L=LoExp(-(\beta h-A)2/B)$$

D>0 is a condition that the parts where the current density is large are not overlapped with each other, which makes it possible to prevent degradation of a phosphor.

Consequently, it becomes realizable to cause electron beams to focus while suppressing the degradation of a phosphor with a simple configuration and, at the same time, a high density and high definition display device can be provided. That is, focusing of electron beams is attained without separately providing a focusing electrode and without providing a special interval (space) of electron-emitting areas or the like for overlapping electron beams.

As described above, according to the present invention, since a high definition display device of a simple configuration can be provided and electron beams are irradiated on parts of phosphors, on which electron beams are not irradiated conventionally, to contribute to emission of light, the Coulomb degradation of a phosphor can be significantly reduced.

As many apparently widely different embodiments of the present invention can be made without departing from the spirit and scope thereof, it is to be understood that the invention is not limited to the specific embodiments thereof except as defined in the appended claims.

What is claimed is:

1. An image display device comprising:

an electron source and a display member for displaying an image by irradiation with electrons emitted from said electron source, wherein said electron source has a plurality of units provided with a higher voltage electrode disposed on a substrate, lower voltage electrodes provided in parallel on both sides of said higher voltage electrode across said higher voltage electrode and electron-emitting areas located between each of said lower voltage electrodes and said higher voltage electrode, electron beams emitted from each of said electron-emitting areas in each unit cross with each other, and said higher voltage electrode has a part higher than said lower voltage electrodes, and wherein a height h ($\mu$m) of said higher voltage electrode from surfaces of said lower voltage electrodes meets the following expressions when an interval between said substrate and an anode electrode provided on said display member is d ($\mu$m), a potential difference between said higher voltage electrode and said lower voltage electrodes is Vf (V), a potential difference between said anode electrode and said lower voltage electrodes is Va (V), a pitch width in a direction of one unit of higher voltage electrode and lower voltage electrodes is Px ($\mu$m) and a distance from the electron-emitting areas and one unit end is $\Delta$Px ($\mu$m):

$$(Va/d)\times\beta h>Vf$$

$$h<(A+(B\times In(2Lo/(Px-2\Delta Px)))^{0.5})/\beta$$

where A is represented by the following expression with a width W ($\mu$m) of the part of said higher voltage electrode higher than the surfaces of said lower voltage electrodes as a parameter:

$$A=-0.5\alpha W+26.2$$

where Lo ($\mu$m) is a curvilinear progression quantity of electron beams and is represented by the following expression:

$$Lo=2Kd(Vf/Va)^{0.5}$$

where K and B are constants and $\alpha$ and $\beta$ are correction factors depending on a shape of said higher voltage electrode.

2. An image display device according to claim 1, wherein both $\alpha$ and $\beta$ are in a range of 0.8 to 1.0.

3. An image display device according to claim 1, wherein said plurality of units are wired in a matrix shape.

4. An image display device according to claim 1, wherein said display member has a plurality of pixels consisting of a plurality of sub-pixels of different colors, and each of said plurality of units is arranged for each of said sub-pixels.

5. An image display device comprising:

an electron source and a display member for displaying an image by irradiation with electrons emitted from said electrons source, wherein said electron source has a plurality of units provided with a higher voltage electrode disposed on a substrate, lower voltage electrodes provided in parallel on both sides of said higher voltage electrode across said higher voltage electrode and electron-emitting areas located between each of said lower voltage electrodes and said higher voltage electrode, electron beams emitted from each of said electron-emitting areas in each unit cross with each other, and said higher voltage electrode has a surface whose height gradually increases or rapidly increases from said electron-emitting area side and has a part higher than said lower voltage electrode, and wherein a height h ($\mu$m) of said higher voltage electrode from surfaces of said lower voltage electrodes meets the following expressions when an interval between said substrate and an anode electrode provided on said display member is d ($\mu$m), a potential difference between said higher voltage electrode and said lower voltage electrodes is Vf (V), a potential difference between said anode electrode and said lower voltage electrodes is Va (V), a pitch width in a direction of one unit of higher voltage electrode and lower voltage electrodes is Px ($\mu$m) and a distance from the electron-emitting areas and one unit end is $\Delta$Px ($\mu$m):

$$(Va/d)\times\beta h>Vf$$

$$h<(A+(B\times In(2Lo/(Px-2\Delta Px)))^{0.5})/\beta$$

where A is represented by the following expression with a width W ($\mu$m) of the part of said higher voltage electrode higher than the surfaces of said lower voltage electrodes as a parameter:

$$A=-0.5\alpha W+26.2$$

where Lo ($\mu$m) is a curvilinear progression quantity of electron beams and is represented by the following expression:

$$Lo=2Kd(Vf/Va)^{0.5}$$

where K and B are constants and $\alpha$ and $\beta$ are correction factors depending on a shape of said higher voltage electrode.

6. An image display device according to claim 5, wherein both $\alpha$ and $\beta$ are in a range of 0.8 to 1.0.

7. An image display device according to claim 5, wherein said plurality of units are wired in a matrix shape.

8. An image display device according to claim 5, wherein said display member has a plurality of pixels consisting of a plurality of sub-pixels of different colors, and each of said plurality of units is arranged for each of said sub-pixels.

9. An image display device comprising:

an electron source and a display member for displaying an image by irradiation with electrons emitted from said electron source, wherein said electron source has a plurality of units provided with a higher voltage device electrode disposed on a substrate, lower voltage device electrodes provided in parallel on both sides of said higher voltage device electrode across said higher voltage device electrode, electron-emitting areas located between each of said lower voltage device electrodes and said higher voltage device electrode and a wiring electrode connected to and disposed on said higher voltage device electrode, electron beams emitted from each of said electron-emitting areas in each unit cross with each other, and said wiring electrode has a part higher than said lower voltage device electrodes, and wherein a height of h (μm) of said wiring electrode from surfaces of said lower voltage device electrodes meets the following expressions when an interval between said substrate and an anode electrode provided on said display member is d (μm), a potential difference between said higher voltage device electrode and said lower voltage device electrodes is Vf(V), a potential difference between said anode electrode and said lower voltage device electrodes is Va(V), a pitch width in a direction of one unit of higher voltage device electrode and lower voltage device electrodes is Px (μm) and a distance from the electron-emitting areas and one unit end is ΔPx (μm):

$$(Va/d))\times\beta h>Vf$$

$$h<(A+(B\times In(2Lo/(Px-2\Delta Px)))^{0.5})/\beta$$

where A is represented by the following expression with a width W (μm) of the part of said wiring electrode higher than the surfaces of said lower voltage electrodes as a parameter:

$$A=-0.5\alpha W+26.2$$

where Lo (μm) is a curvilinear progression quantity of electron beams and is represented by the following expression:

$$Lo=2Kd(Vf/Va)^{0.5}$$

where K and B are constants and α and β are correction factors depending on a shape of said wiring electrode.

10. An image display device according to claim 9, wherein both α and β are in a range of 0.8 to 1.0.

11. An image display device according to claim 9, wherein said lower voltage device electrodes are connected to a row-directional wiring, said wiring electrode forms a column-directional wiring, and said plurality of units are wired in a matrix shape by a plurality of lines of said row-directional wiring and a plurality of lines of said column-directional wiring.

12. An image display device according to claim 9, wherein said display member has a plurality of pixels consisting of a plurality of sub-pixels of different colors, and each of said plurality of units is arranged for each of said sub-pixels.

13. An image display device according to claim 9, wherein said electron-emitting areas are arranged among said higher voltage device electrode and said lower voltage device electrodes and are electro-conductive films connected to both the device electrodes.

14. An image display device comprising:

an electron source and a display member for displaying an image by irradiation with electrons emitted from said electron source, wherein said electron source has a plurality of units provided with a higher voltage device electrode disposed on a substrate, lower voltage device electrodes provided in parallel on both sides of said higher voltage device electrode across said higher voltage device electrode, electron-emitting areas located between each of said lower voltage device electrodes and said higher voltage device electrode and a wiring electrode connected to and disposed on said higher voltage device electrode, electron beams emitted from each of said electron-emitting areas in each unit cross with each other, and a step is formed by said higher voltage device electrode and said wiring electrode and said wiring electrode has a part higher than said lower voltage device electrodes, and wherein a height of h (μm) of said wiring electrode from surfaces of said lower voltage device electrodes meets the following expressions when an interval between said substrate and an anode electrode provided on said display member is d (μm), a potential difference between said higher voltage device electrode and said lower voltage device electrodes is Vf(V), a potential difference between said anode electrode and said lower voltage device electrodes if Va(V), a pitch width in a direction of one unit of higher voltage device electrode and lower voltage device electrodes is Px (μm) and a distance from the electron-emitting areas and one unit end is ΔPx (μm):

$$(Va/d)\times\beta h>Vf$$

$$h<(A+(B\times In(2Lo/(Px-2\Delta Px)))^{0.5})/\beta$$

where A is represented by the following expression with a width W (μm) of the part of said wiring electrode higher than the surfaces of said lower voltage electrodes as a parameter:

$$A=-0.5\alpha W+26.2$$

where Lo (μm) is a curvilinear progression quantity of electron beams and is represented by the following expression:

$$Lo=2Kd(Vf/Va)^{0.5}$$

where K and B are constants and α and β are correction factors depending on a shape of said wiring electrode.

15. An image display device according to claim 14, wherein both α and β are in a range of 0.8 to 1.0.

16. An image display device according to claim 14, wherein said lower voltage device electrodes are connected to a row-directional wiring, said wiring electrode forms a column-directional wiring, and said plurality of units are wired in a matrix shape by a plurality of lines of said row-directional wiring and a plurality of lines of said column-directional wiring.

17. An image display device according to claim 14, wherein said display member has a plurality of pixels consisting of a plurality of sub-pixels of different colors, and each of said plurality of units is arranged for each of said sub-pixels.

18. An image display device according to claim 14, wherein said electron-emitting areas are arranged among said higher voltage device electrode and said lower voltage device electrodes and are electro-conductive films connected to both the device electrodes.

* * * * *

UNITED STATES PATENT AND TRADEMARK OFFICE

CERTIFICATE OF CORRECTION

PATENT NO. : 6,703,791 B2
DATED : March 9, 2004
INVENTOR(S) : Hisanobu Azuma

It is certified that error appears in the above-identified patent and that said Letters Patent is hereby corrected as shown below:

Title page,
Item [56], References Cited, OTHER PUBLICATIONS, "R. Meyer et al." reference, "R. Meyer et al." should read -- R. Meyer et al., --.

Column 14,
Line 14, "wrings" should read -- wirings --; and
Line 15, "wrings" should read -- wirings --.

Column 16,
Line 11, "spreads" should read -- spread --.

Column 21,
Line 23, "(Va/d))" should read -- (Va/d) --.

Signed and Sealed this

Twenty-eighth Day of June, 2005

JON W. DUDAS
*Director of the United States Patent and Trademark Office*